US008723107B2

(12) United States Patent
Whitehouse et al.

(10) Patent No.: US 8,723,107 B2
(45) Date of Patent: May 13, 2014

(54) MULTIPOLE ION GUIDE INTERFACE FOR REDUCED BACKGROUND NOISE IN MASS SPECTROMETRY

(71) Applicant: PerkinElmer Health Sciences, Inc., Waltham, MA (US)

(72) Inventors: Craig M. Whitehouse, Branford, CT (US); David G. Welkie, Trumbull, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 13/932,716

(22) Filed: Jul. 1, 2013

(65) Prior Publication Data

US 2014/0008530 A1 Jan. 9, 2014

Related U.S. Application Data

(63) Continuation of application No. 11/809,349, filed on May 31, 2007, now Pat. No. 8,507,850.

(51) Int. Cl.
*H01J 49/00* (2006.01)

(52) U.S. Cl.
USPC ..... 250/283; 250/281; 250/282

(58) Field of Classification Search
None
See application file for complete search history.

(56) References Cited

U.S. PATENT DOCUMENTS

| | | | | |
|---|---|---|---|---|
| 3,334,225 | A | 8/1967 | Langmuir | |
| 3,410,997 | A | 11/1968 | Brubaker | |
| 3,473,020 | A | 10/1969 | Brubaker | |
| 4,963,736 | A | 10/1990 | Douglas et al. | |
| 5,171,990 | A | 12/1992 | Mylchreest et al. | |
| 5,179,278 | A | 1/1993 | Douglas | |
| 5,481,107 | A * | 1/1996 | Takada et al. | 250/281 |
| 5,652,427 | A | 7/1997 | Whitehouse et al. | |
| 5,672,868 | A * | 9/1997 | Mordehai et al. | 250/281 |
| 5,818,041 | A * | 10/1998 | Mordehai et al. | 250/281 |
| 5,939,718 | A * | 8/1999 | Yamada et al. | 250/288 |

(Continued)

FOREIGN PATENT DOCUMENTS

| | | |
|---|---|---|
| EP | 0237259 | 9/1987 |
| JP | S62-264546 | 11/1987 |

(Continued)

OTHER PUBLICATIONS

A.F. Dodonov et al., "Atmospheric Pressure Ionization Time-of-Flight Mass Spectrometer," *Proc. 12th Int'l Mass. Spec. Conf.* 153 (1991).

(Continued)

*Primary Examiner* — Andrew Smyth
(74) *Attorney, Agent, or Firm* — Fish & Richardson P.C.

(57) ABSTRACT

Ions that are transported from an ion source to a mass spectrometer for mass analysis are often accompanied by background particles such as photons, neutral species, and cluster or aerosol ions which originate in the ion source. Background particles are also produced by scattering and neutralization of ions during collisions with background gas molecules in higher pressure regions with line-of-sight to the mass spectrometer detector. In either case, such background particles produce noise in mass spectra. Apparatus and methods are provided in which a multipole ion guide is configured to efficiently transport ions through multiple vacuum stages, while preventing background particles, produced both in the ion source and along the ion transport pathway, from reaching the detector, thereby improving signal-to-noise in mass spectra.

13 Claims, 14 Drawing Sheets

(56) References Cited

U.S. PATENT DOCUMENTS

| | | | | |
|---|---|---|---|---|
| 5,962,851 | A | 10/1999 | Whitehouse et al. | |
| 6,069,355 | A * | 5/2000 | Mordehai | 250/281 |
| 6,188,066 | B1 * | 2/2001 | Whitehouse et al. | 250/288 |
| 6,403,953 | B2 | 6/2002 | Whitehouse et al. | |
| 6,410,915 | B1 | 6/2002 | Bateman et al. | |
| 6,417,511 | B1 | 7/2002 | Russ et al. | |
| 6,614,021 | B1 | 9/2003 | Kalinitchenko | |
| 6,730,904 | B1 | 5/2004 | Wells | |
| 6,753,523 | B1 | 6/2004 | Whitehouse et al. | |
| 6,762,407 | B2 * | 7/2004 | Kalinitchenko | 250/294 |
| 6,809,312 | B1 | 10/2004 | Park et al. | |
| 6,872,940 | B1 | 3/2005 | Thakur | |
| 6,987,264 | B1 | 1/2006 | Whitehouse et al. | |
| 7,034,292 | B1 | 4/2006 | Whitehouse et al. | |
| 7,053,368 | B2 | 5/2006 | Thakur | |
| 7,112,786 | B2 | 9/2006 | Russ et al. | |
| 7,189,967 | B1 | 3/2007 | Whitehouse et al. | |
| 7,230,234 | B2 | 6/2007 | Kobayashi | |
| 7,332,715 | B2 | 2/2008 | Russ et al. | |
| 7,335,878 | B2 | 2/2008 | Beene et al. | |
| 7,351,963 | B2 | 4/2008 | Rebettge et al. | |
| 7,365,312 | B2 | 4/2008 | Laskin et al. | |
| 7,365,317 | B2 | 4/2008 | Whitehouse et al. | |
| 7,372,042 | B2 | 5/2008 | Mordehai et al. | |
| 7,391,019 | B2 | 6/2008 | Dunyach et al. | |
| 7,858,926 | B1 * | 12/2010 | Whitehouse et al. | 250/281 |
| 2001/0030284 | A1 * | 10/2001 | Dresch et al. | 250/287 |
| 2001/0035498 | A1 | 11/2001 | Li et al. | |
| 2003/0038236 | A1 | 2/2003 | Russ et al. | |
| 2003/0155498 | A1 | 8/2003 | Kato | |
| 2003/0160168 | A1 * | 8/2003 | Speakman et al. | 250/288 |
| 2004/0026614 | A1 * | 2/2004 | Bateman et al. | 250/281 |
| 2004/0211897 | A1 | 10/2004 | Kim et al. | |
| 2005/0151074 | A1 | 7/2005 | Thakur | |
| 2005/0258364 | A1 * | 11/2005 | Whitehouse et al. | 250/292 |
| 2006/0016982 | A1 | 1/2006 | Russ et al. | |
| 2006/0016983 | A1 | 1/2006 | Kobayashi | |
| 2006/0027745 | A1 | 2/2006 | Rebettge et al. | |
| 2006/0043285 | A1 | 3/2006 | Laskin et al. | |
| 2006/0145072 | A1 * | 7/2006 | Wang et al. | 250/290 |
| 2006/0284076 | A1 | 12/2006 | Scheidemann et al. | |
| 2007/0045531 | A1 | 3/2007 | Mordehai et al. | |
| 2007/0085001 | A1 | 4/2007 | Beene et al. | |
| 2007/0114390 | A1 | 5/2007 | Laskin et al. | |
| 2007/0278397 | A1 | 12/2007 | Bateman et al. | |
| 2008/0116371 | A1 | 5/2008 | Wouters et al. | |
| 2008/0185511 | A1 | 8/2008 | Senko | |

FOREIGN PATENT DOCUMENTS

| | | |
|---|---|---|
| JP | 2000-268770 | 9/2000 |
| JP | 2004-111149 | 4/2004 |
| WO | 99/62101 | 12/1999 |

OTHER PUBLICATIONS

B.A. Mamyrin & D.V. Shmikk, "The Linear Mass Reflectron," 49(5) *Sov. Phys. JETP* 762 (1979).

B.A. Mamyrin et al., "The mass-reflectron, a new nonmagnetic time-of-flight mass spectrometer with high resolution," *37 Soy. Phys. JETP* 45 (1973).

Claude Beaugrand et al., "How to Use a Standard Quadrupole Filter as a Two Dimensional Ion-Trap," *Proc. 37th ASMS Conf. on Mass Spectrometry & Allied Topics* (1989).

D.W. Thomas, "The Reactions of Ions with Molecules in the Gas Phase and the Sputtering of Solid Surfaces by Ion Bombardment," Time-of-Flight Mass Spectrometry 171-210 (1969).

Dawson, "Quadropole Mass Spectrometry and Its Applications," pp. 34-35 and 138-139, May 9, 1997.

G.L. Glish & D.E. Goeringer, "Tandem Quadrupole/Time-of-Flight Instrument for Mass Spectrometry/Mass Spectrometry," 56(13) Analytical Chem. 2291-29 (1984).

G.L. Glish et al., "Improved Performance of a Tandem Quadrupole/Time-of-Flight Mass Spectrometer," 16(1) Analytical Instrumentation 191-206 (1987).

Hong Jie Xu et al., "A new cooling & focusing device for ion guide," 33 *Nuclear Inst. & Methods in Phys. Res.* A 274-81 (1993).

International Search Report and Written Opinion for corresponding PCT application PCT/US2008/064984 dated Feb. 27, 2009.

J.H.J. Dawson & M. Guilhaus, "Orthogonal-acceleration Time-of-flight Mass Spectrometer," 3(5) *Rapid Comm. Mass. Spec.* 155-59 (1989).

James G. Boyle & Craig M. Whitehouse, "Time-of-Flight Mass Spectrometry with an Electrospray Ion Beam," 64 *Analytical Chem.* 2084-89 (1992).

John Coles & Michael Guilhaus, "Orthogonal acceleration—a new direction for time-of-flight mass spectrometry: fast, sensitive mass analysis for continuous ion sources," 12(5) *Trends in Analytical Chem.* 203-13 (1993).

K.L. Busch, G.L. Glish, and S.A. McLuckey, "Mass Spectrometry/Mass Spectrometry: Techniques and Applications of Tandem Mass Spectrometry" (1989).

*McGraw-Hill Dictionary of Scientific & Technical Terms* 1520 (4th ed. 1989).

Office Action in Australian Application No. 2008302733, dated Dec. 20, 2012, 3 pages.

Office Action in Japanese Application No. 2010-510468, dated Jan. 8, 2013 (5 pages).

Random house Webster's Unabridged Dictionary 1566 (2d ed 2001).

Steven M. Michael et al., "An ion trap storage/time-of-flight mass spectrometer," 63(10) Rev. Sci. Instrum. 4277-84 (1992).

Supplementary European Search Report dated Nov. 20, 2012 for Application No. 08831810.0, 12 pages.

T. Bergmann et al., "High-resolution time-of-flight mass spectrometer," 60(4) *Rev. Sci. Instrum.* 792-93 (1989).

Th.L. Grebner & H. J. Neusser, "Laser produced ions in a cylindrical ion trap & detected in a reflectron time-of-flight mass spectrometer," 137 Int'l Mass Spect. & Ion Processes L1-L6 (1994).

The American Heritage Dictionary of the English Language 1467 (3rd ed 1992).

*Webster's Third New Int'l Dictionary* 1841 (1986).

* cited by examiner

MULTIPOLE ION GUIDE INTERFACE FOR REDUCED BACKGROUND NOISE IN MASS SPECTROMETRY

CROSS-REFERENCE TO RELATED APPLICATIONS

The present application is a continuation of U.S. patent application Ser. No. 11/809,349, filed on May 31, 2007, the entire contents of which are hereby incorporated by reference herein.

FIELD OF THE INVENTION

The present invention relates to mass spectrometry and in particular to apparatus and methods for transporting ions with a multipole ion guide through multiple vacuum pumping stages with reduced background particle noise.

BACKGROUND OF THE INVENTION

Mass analyzers are used to analyze solid, liquid, and gaseous samples by measuring the mass-to-charge (m/z) ratio of ions produced from a sample in an ion source. Many types of ion sources operate at relatively high pressure, that is, higher than vacuum pressure required by the mass analyzer and/or detector. For example, some types of ion sources operate at or near atmospheric pressure, such as electrospray (ES), atmospheric pressure chemical ionization (APCI), inductively coupled plasma (ICP), and atmospheric pressure (AP-) MALDI and laser ablation ion sources. Other types of ion sources operate at intermediate vacuum pressures, such as glow discharge or intermediate pressure (IP-) MALDI and laser ablation ion sources. Still other types of ion sources are configured in a vacuum region in which the vacuum pressure may increase during operation of the ion source, such as electron ionization and chemical ionization ion sources.

Ion sources operated at higher pressures are usually configured to deliver ions into the vacuum region of the mass analyzer via one or more differential pumping vacuum stages that isolate the mass analyzer and detector from the higher pressure of the upstream stages. In such configurations, an ion optical arrangement is typically configured between the ion source and the mass analyzer entrance in order to facilitate transfer of ions from the ion source to the mass analyzer entrance through the multiple vacuum pumping stages, while restricting the flow of background gas into the mass analyzer region.

Apart from efficiently transferring ions from the ion source to the mass analyzer, such ion optical arrangements are also often configured to prevent background particles originating in the ion source from reaching the mass analyzer detector, where they would produce background noise in the mass spectra. Depending on the type of ion source, such particles may include photons, undesolvated cluster ions and neutral species, electrons, and charged and uncharged aerosol particles. Such particles may not be effectively eliminated by the mass analyzer, if at all, in which case they may produce background noise in the recorded mass spectra, thereby limiting the achievable signal-to-noise ratio. Consequently, depending on the type of ion source employed and the instrument configuration, various approaches to preventing such background particles from reaching the mass analyzer detector have been devised.

One approach that is now common practice is to locate the detector outside the field of view from the ion source, as described, e.g., in Dawson, "Quadrupole Mass Spectrometry and Its Applications", pp. 34-35 and 138-139. In these so-called 'off-axis' detector configurations, most photons and neutral species emanating from the ion source follow flight paths that miss the detector, while mass analyzed ions of interest are deflected with electric fields to intersect with the detector. Most of these configurations consist simply of misaligning the detector with the exit of the mass analyzer, possibly combined with some electrostatic deflector for steering ions to the detector. However, relatively complicated versions of such arrangements were also proposed, for example, by Brubaker in U.S. Pat. No. 3,410,997, in which curved ion guides were configured to transport the mass-analyzed ions from the exit of a quadrupole mass analyzer to a detector.

It is usually more advantageous, however, to remove undesirable particles from the ion path before they enter the mass analyzer. One reason for this is that the impingement of such particles on surfaces in the mass analyzer may result in the buildup of an electrically insulating layer of contamination on surfaces, which may accumulate charge that distorts electric fields and degrade performance. Another reason is that the impact of such particles on surfaces may create secondary particles which may, in turn, find their way to the mass spectrometer detector and create noise. Hence, for example, Brubaker further described in U.S. Pat. No. 3,473,020 a number of arrangements in which curved ion guides are configured before the entrance to a quadrupole mass filter, whereby ions of interest are guided to the mass filter entrance, while photons and neutral species proceed undeflected and thus do not enter the mass filter.

A number of alternative configurations have since been developed with at least one of the objectives being to prevent background particles originating with the ion source, such as photons, neutrals, charged droplets, etc., from reaching a mass analyzer detector. For example, Mylchreest et al. describe in U.S. Pat. No. 5,171,990 apparatus and methods for preventing high velocity droplets or particles, emanating from a capillary orifice into vacuum from an atmospheric pressure ion (API) source, from proceeding into the lens region at the entrance of a mass analyzer. Essentially, Mylchreest et al. describe orienting the capillary so that its axis is offset from a skimmer orifice or aperture separating the capillary exit vacuum region from the vacuum region of the mass analyzer entrance lens. Hence, high velocity droplets and particles traveling along the axis of the capillary are blocked from proceeding into the mass analyzer region, while ions of interest are deviated from the axis to travel through the orifice or aperture by virtue of their free jet expansion from the capillary exit. However, such a configuration would suffer from contamination buildup on the orifice or aperture, leading to unstable operation due to electrostatic charging. Also, the transmission efficiency of ions would degrade due to scattering of ions out of the deviated flight path from background gas molecules in this relatively high pressure region.

Takada et al. describe in U.S. Pat. No. 5,481,107 the incorporation of an electrostatic lens disposed between an API source and the entrance to a mass analyzer. The mass analyzer axis and that of the ion source and interface optics is offset so as to prevent droplets and neutral species from proceeding past the entrance aperture of the mass analyzer, while the electrostatic lens is configured to re-direct ions of interest from the axis of the ion source and interface optics into the mass analyzer entrance aperture. One difficulty with such an arrangement is that ions entering vacuum via such AP/vacuum interfaces typically exhibit similar velocity distributions, more or less independent of their mass. This results in ion kinetic energies that depend strongly on ion mass, and, because the focusing action of electrostatic lenses in vacuum depends only on ion kinetic energy and ion charge, and not ion mass, such a configuration leads to severe mass discrimination effects.

Mordehai et al. describe in U.S. Pat. Nos. 5,672,868, 5,818,041, and 6,069,355, configurations in which a multipole RF ion guide is located between an ion source and the entrance to a mass analyzer. Ions are transported from the ion source to the input end of the ion guide along an axis that is at an angle with respect to the axis of the ion guide. The ions enter the input end of the ion guide while they are entrained in an aerodynamic jet emanating from the ion source, or from an ion transport device such as a capillary. Ions entering the input region of the ion guide are re-directed to move along the ion guide axis via the action of the RF fields in the ion guide, and are transported by the ion guide to the entrance of the mass analyzer. Neutral and energetic charged particles continue more or less along their original trajectories and are lost to the surrounding surfaces. However, as with the apparatus and methods of Takada et al. '107, described above, ions entrained in an aerodynamic jet have ion kinetic energies that depend on ion mass. Hence, the re-directing of ions by the RF fields in the ion guide with good efficiency requires that the ions be quickly collisionally cooled by collisions with background gas molecules, which is increasingly more important the greater the ion mass, hence ion energy. Hence, Mordehai et al. provide a separate gas inlet to let in extra 'buffer', or collision, gas for this purpose. Because the ion guide is located entirely within a single vacuum stage, the gas pressure would not be substantially different from one end of the ion guide to the other end. Hence, the probability of collisions between ions and background gas molecules as ions exit the ion guide would have to be substantial in the apparatus of Mordehai at al., resulting in degraded transport efficiency in this region. Such scattering is also known to lead to increased background noise at the detector, due to the acceleration of scattered ions in the RF fringe fields in this region, as well as the production of energetic neutral species due charge-exchange neutralization of such accelerated ions (as discussed below).

Wells describes in U.S. Pat. No. 6,730,904 a multipole ion guide that is configured in segments, where different segments may be operated with independent voltages. This allows ions traversing the ion guide to be guided along different optical axes within the ion guide from one segment to the next, where the different axes are offset with respect to each other. Wells describes such segmented ion guide configurations in which ions and neutral particles enter the ion guide along an entrance axis, and the ions are then guided so as to exit the ion guide along an exit axis that is offset from the entrance axis. The neutrals proceed along the entrance axis direction and are thereby prevented from proceeding past the ion guide exit. Again, the efficiency of ion transport depends on collisionally cooling energetic ions as they enter the ion guide. For example, Wells demonstrates through computer simulations of one embodiment that many more ions are lost to the ion guide electrodes when the gas pressure in the ion guide is reduced from a pressure corresponding to a mean free path of 1 mm to a pressure corresponding to a mean free path of 10 mm. Hence, as with the apparatus and methods described by Mordehai et al., as discussed above, a significant background gas pressure is expected in the region where ions exit the ion guide, resulting in collisions between ions and background gas molecules in this region, which ultimately leads to increased background noise at a downstream detector.

In European Patent Application 0 237 259 A2, Syka describes tandem quadrupole mass spectrometer configurations, some of which include a bent or tilted quadrupole ion guide positioned just before the final quadrupole mass analyzer and detector. The bent or tilted quadrupole ion guide is described to reduce noise by preventing excited and fast neutral particles and fast ions emanating from an ion source from reaching the detector, because the tilted or bent quadrupole removes the detector from line-of-sight of the ion source. The entrance and exit ends of such bent quadrupole ion guide reside in the same vacuum stage limiting the ions within the bent quadrupole ion guide to traverse a single background pressure region constrained by the single vacuum stage pumping speed.

Kalinitchenko describes in U.S. Pat. No. 6,614,021 a configuration of an ICP/MS instrument that incorporates an electrostatic mirror between an ICP ion source and a quadrupole mass analyzer. The mirror provides an electrostatic focusing field that deflects ions from the ion source, for example, by 90 degrees, and focuses them through an aperture at the entrance of the quadrupole mass analyzer. Such an arrangement avoids any line-of-sight from the ion source to the detector, thereby preventing background particles originating in the ion source, such as photons and energetic neutral species, from reaching the detector. Kalinitchenko reports a substantial increase in sensitivity relative to prior art, measured as counts/sec per parts-per-million (ppm) of analyte. However, the increase was achieved "without attendant increase in background" noise, implying that significant background noise persisted as in previous configurations, in spite of the reflecting mirror.

All of the prior art discussed above describe apparatus and methods to reduce or eliminate background noise caused primarily by undesirable particles emanating from an ion source. However, it is now appreciated that background particle noise can also originate from other sources besides the ion source. For example, while the reflecting mirror arrangement of Kalinitchenko described in U.S. Pat. No. 6,614,021, discussed above, provided for no possible line-of-sight between the ion source and the detector, the significant background noise that was previously observed nevertheless persisted, demonstrating that such background particle noise must in fact originate from processes separate from the ion source itself. The observed non-source-related background noise was reduced substantially, as described subsequently by Kafinitchenko in U.S. Pat. No. 6,762,407, by incorporating a set of curved, or tilted, 'fringe' electrodes between the entrance of the quadrupole mass analyzer and the quadrupole entrance aperture. Kalinitchenko suggests that energetic neutral particles are produced as ions are accelerated through residual gas in the apparatus. That is some ions inevitably interact with background gas molecules, for example, via resonant charge exchange processes, resulting in conversion of the accelerating ions into energetic neutral species. Another possible explanation is that such acceleration leads to some degree of ion fragmentation, resulting in energetic neutral fragments that are on a favorable trajectory to reach the mass analyzer detector.

Kalinitchenko further describes that such collisions occur not only during acceleration of ions along their axial motion direction, such as in the reflecting mirror region, but also along directions orthogonal to their axial direction, for example, in the fringe fields between the end of an RF multipole ion guide and an aperture proximal to the end. Hence, the curved or tilted 'fringe' electrodes described by Kalinitchenko in the '407 patent prevented energetic neutrals created in the electrostatic mirror vacuum region, and in the region of the entrance aperture and the upstream section of the 'fringe' electrode structure, from reaching the detector.

On the other hand, it is well known that the interactions between ions and background gas molecules involve not only the neutralization of the ions, but also scattering of ions out of the beam path, resulting in additional ion loss. Ion losses also occur due to scattering by oscillating fringe fields proximal to the entrance or exit of an RF multipole ion guide. In any case, the ion transmission efficiency in the apparatus and methods described in the '407 patent by Kalinitchenko would be reduced due to ions lost by scattering with background gas molecules as they move from the relatively higher background pressure vacuum region of the reflecting mirror, through the vacuum interface aperture, and traverse the region between the interface aperture and the RF 'fringe' field electrodes.

The loss of ions due to scattering with background gas molecules in vacuum regions of higher background gas pressure is frequently minimized by transporting ions through such regions within an RF multipole ion guide. The RF fields within such ion guides generate an effective repelling force directed orthogonally to the ion beam direction, that is, orthogonal to the ion guide axis, thereby counteracting such scattering out of the beam path. Further, such collisions serve to dampen the ions' kinetic energy, which allows the ions to settle closer to the ion guide axis, thereby improving transport efficiency. However, significant scattering losses nevertheless occur when ions must exit the ion guide in a region where collisions with background gas molecules are likely. This is a problem typically encountered in conventional multiple vacuum stage vacuum systems, in which static electric field vacuum partitions separate the different vacuum stages. Ions traveling within an ion guide through one vacuum stage with a relatively higher vacuum pressure must exit the ion guide and traverse an aperture provided in the vacuum partition to move into the next vacuum stage that has a lower gas pressure, with such conventional vacuum stage configurations. Ions are lost due to scattering in collisions with background gas molecules once they exit the ion guide, and ions are also lost due to scattering by fringe fields between the aperture and the ion guide exit in the upstream vacuum stage, or between the aperture and the ion guide entrance in the downstream vacuum stage. Even if the gas pressure in the next vacuum stage is low enough, on average, that collisions between ions and gas molecules are rare, nevertheless, ions may experience frequent collisions with gas molecules that flow from the upstream, higher background gas pressure vacuum stage into the lower pressure downstream vacuum stage in the vicinity to the interface aperture.

The problem of ion loss during transit between vacuum stages has been effectively addressed by Whitehouse, et al. In U.S. Pat. Nos. 5,652,527; 5,962,851; 6,188,066; and 6,403,953, which describe extending an RF multipole ion guide through the vacuum partitions between two or more vacuum stages. Essentially, these patents describe RF multipole ion guides that effectively transport ions through and between vacuum stages at high and low background gas pressures, and are configured with a small enough cross-section to act as an effective restriction to gas flow between vacuum stages, similar to an aperture or orifice in a vacuum partition. Whitehouse et al. further describes in these documents the incorporation of multipole ion guides extending through multiple vacuum pumping stages between API sources and mass analyzers.

This same situation also exists at the entrance and exit of a conventional collision cell, in which a multipole ion guide is located in a region of gas pressure that is high enough so that ions collide with background gas molecules as they traverse the ion guide. Although ions are prevented from scattering out of the beam path by the RF fields of the ion guide while traversing the ion guide, the ions typically must enter and exit the ion guide via apertures at the ends of the collision cell that help maintain a pressure differential between the region internal to the collision cell and vacuum regions external to the collision cell. Hence, ions are scattered by collisions with collision gas molecules as the ions enter and leave the collision cell, resulting in ion losses. Furthermore, background particles in the form of energetic neutral species may be created as a result of ions being accelerated into the collision cell for the purpose of collision-induced fragmentation. Some of these energetic neutral species may continue through the exit of the collision cell, and into a mass analyzer and detector located downstream, thereby creating background particle noise. Furthermore, ions exiting the collision cell must pass through the RF fringe fields between the ion guide exit end and the exit aperture of the collision cell. This is also a region where collisions between ions and gas molecules occur, resulting in ion scattering losses, as well as ion neutralization via charge exchange, for example. As discussed above, it is known that ions may be accelerated to higher energies in such RF fringe fields, and neutralization of energetic ions creates energetic neutral species, which then also may continue on downstream to create background noise in a mass analyzer and detector.

The problem of ion loss during ion transit into and out of a conventional collision cell has also been addressed by Whitehouse. et al. in U.S. Pat. No. 7,034,292, which describes configurations that include a multipole ion guide that extends continuously from inside a collision cell to outside the collision cell, where the multipole ion guide terminates in a region of background pressure that is low enough that collisions between ions and background gas molecules essentially do not occur. In such configurations, ions do not experience RF fringe fields until they are in a vacuum region with low enough background gas pressure that collisions with background gas molecules essentially do not occur. Nevertheless, energetic neutral species that are created by collisions between ions and collision gas molecules as the ions are accelerated into the collision cell remain a potential source of background particle noise at a mass analyzer detector located downstream of the collision cell.

In all of the configuration described by Whitehouse in U.S. Pat. Nos. 5,652,527; 5,962,851; 6,188,066; 6,403,953; and 7,034,292, multipole ion guides were configured to be in axial alignment between the ion source and the entrance to a mass analyzer. In other words, no provision was made for preventing background particles emanating from an ion source, or created along the beam path from collisions with background gas molecules, from entering a mass analyzer or from reaching a mass analyzer detector. Hence, there has not been available a solution to the problem of providing efficient transport of ions between a region of higher background gas pressure, at which collisions between ions and background gas molecules occur, and a region of lower background gas pressure, at which such collisions essentially do not occur, while simultaneously preventing background particles originating either from an ion source, and/or created in collisions between ions and background gas molecules during ion transit, from reaching a mass analyzer detector and thereby causing background noise in mass spectra.

SUMMARY OF THE INVENTION

Accordingly, it is one object of the present invention to reduce the number of background particles emanating from an ion source that reach a mass analyzer detector, while improving the transmission efficiency of ions to the mass analyzer.

Another object of the present invention is to reduce the number of background particles, created from collisions between ions and background gas molecules, that reach a mass analyzer detector, while improving the transmission efficiency of ions to the mass analyzer.

Another object of the present invention is to simultaneously reduce the number of background particles, created both from collisions between ions and background gas molecules, as well as background particles that emanate from an ion source, that reach a mass analyzer detector, while improving the transmission efficiency of ions to the mass analyzer.

A still further object of the present invention is to reduce the number of background particles, both emanating from an ion source and created by collisions between ions and background gas molecules, that are able to enter a mass analyzer, while improving the transmission efficiency of ions to the mass analyzer.

These and other objectives are achieved by providing an RF multipole ion guide, in a multiple-vacuum pumping stage vacuum system, that extends continuously through at least one vacuum partition between an upstream region (farther from a mass analyzer detector) of higher gas pressure and a downstream region of lower gas pressure. The ion guide is configured with an axis that is tilted, bent or curved, with respect to the subsequent direction of an ion beam as it enters a mass analyzer, so as to prevent, simultaneously, any line-of-sight between an upstream ion source region, as well as any and all higher pressure regions in which collisions between ions and background gas molecules occur, and the mass analyzer detector, in particular, the disclosed invention prevents background particles from reaching the mass analyzer detector which are created in the vicinity of the vacuum partition, through which the RF multipole ion guide extends, which separates an upstream region of higher background gas pressure at which collisions between ions and background gas molecules occur, and subsequent downstream vacuum regions at lower background gas pressure at which such collisions are insignificant. Consequently, this vacuum partition will be referred to herein as a 'high pressure vacuum partition'. Some embodiments of the invention also eliminate any line-of-sight between any such regions in which background particles are created, and the entrance to the mass analyzer, in addition to the mass analyzer detector.

Hence, the embodiments of the invention uniquely provide for the efficient transport of ions through and between vacuum pumping stages, while simultaneously eliminating background noise that originates from background particles emanating from an ion source, as well as background particles that are created from collisions between ions and background gas molecules during ion transport. Consequently, the invention provides apparatus and methods that both improve signal and reduce background particle noise simultaneously, with reduced cost and complexity, compared to prior art.

Four categories of background noise particles are distinguished here: (1) background particles that emanate directly from an ion source, such as charged and uncharged droplets, and energetic neutral species and ions, and which create background noise by impinging on the detector directly; (2) background particles that emanate directly from an ion source and which impact surfaces within the mass analyzer or near the detector, thereby creating secondary particles that subsequently impinge on the detector and create background noise; (3) background particles, such as energetic neutral and ionic species, that are created as ions collide with background gas molecules during transit toward a mass analyzer entrance, and which create background noise by impinging on the detector directly; and (4) background particles that are created as ions collide with background gas molecules during transit, and which impact surfaces within the mass analyzer or near the detector, thereby creating secondary particles that subsequently impinge on the detector and create background noise. All embodiments of the subject invention prevent background noise from particles of categories (1) and (3), that is, which prevent background particles of any origin outside the mass analyzer from reaching the mass analyzer detector directly. Some embodiments of the subject invention also prevent background noise from particles of categories (2) and (4), as well, that is, which prevent background particles of any origin from even passing through the entrance to a mass analyzer. Still other embodiments also prevent any background particles that are created upstream of the 'high pressure vacuum partition' from passing beyond this vacuum partition and into the downstream low pressure vacuum region.

In some embodiments, a linear multipole ion guide is configured to extend continuously from an upstream vacuum pumping stage into a downstream vacuum pumping stage, and through a vacuum partition, that is, a 'high pressure vacuum partition', between the two vacuum pumping stages, such that the central axis of the ion guide is configured with a tilted orientation angle with respect to the entrance axis of a mass analyzer located downstream. The background gas pressure in the vacuum pumping stage in which the ion guide exit is located is low enough to allow ions to move without collisions with background gas molecules from the ion guide exit into the entrance of the mass analyzer. However, the background gas pressure in the immediately preceding vacuum pumping stage may be high enough that such collisions can occur with significant frequency. The ion guide is configured such that the mounting structure that supports the rods or poles of the multipole ion guide is integrated as an extension of the vacuum partition between the vacuum stage in which the ion guide exit is located, and the immediately preceding vacuum stage, so that the ion guide acts as an effective restriction to the flow of gas between these vacuum pumping stages, as described by Whitehouse at al., in U.S. Pat. Nos. 5,652,527; 5,962,851; 6,188,066; and 6,403,953. This partition is configured in the embodiments of the present invention at a distance from the mass analyzer entrance that is far enough away to ensure that any background particles that may be created by collisions between ions and background gas molecules in the vicinity of this partition do not have any line-of-sight trajectory to the mass analyzer detector, due to the tilted angle between the ion guide axis and the axis of the mass analyzer entrance.

Such a configuration also ensures that there is no line-of-sight between any region upstream of this vacuum partition and the mass analyzer detector, thereby also ensuring that any background particles originating with an upstream ion source or higher pressure region such as a collision cell, or the entrance region of the ion guide, have no line-of-sight to the mass analyzer detector as well. Hence, the embodiments disclosed herein that incorporate such a multipole ion guide configuration, will prevent background noise from particles of categories (1) and (3) from reaching the mass analyzer detector.

In some embodiments, the ion guide exit may be positioned proximal to the mass analyzer entrance, so that ions are directed into the mass analyzer immediately after exiting the ion guide, possibly with the help of an electrostatic steering or deflecting electrode located at the ion guide exit. However, the ion guide exit may also be positioned some distance away from the mass analyzer entrance, in which case, one or more additional ion transport devices, such as electrostatic lenses and/or deflection devices, and/or one or more additional multipole ion guides, all of which are well-known in the art, may be employed to efficiently transport ions from the ion guide exit to the mass analyzer entrance. Depending on the separation distance between the exit of the ion guide and the entrance to the mass analyzer, the tilt angle between the linear ion guide axis and the axis of the mass analyzer entrance, combined with the separation between the ion guide exit and the mass analyzer entrance, also prevents background particles from even passing through the mass analyzer entrance, thereby providing further protection from background particle noise by eliminating background particles of categories (2) and (4) as well as (1) and (3).

In other embodiments of the disclosed invention, a multipole ion guide that extends continuously through a 'high pressure vacuum partition' may be configured with a bend or curve located downstream of the vacuum partition, such that the axis of the ion guide at its exit end is coaxial with a mass analyzer entrance. The axis of the mass analyzer entrance will be oriented at an angle with respect to the tangent to the axis of the ion guide at the point at which the ion guide extends through the 'high pressure vacuum partition', as in the previously-described embodiments. However, a bend or curve in the ion guide eliminates the requirement in the previously-described embodiments that ions exit the multipole ion guide before they are re-directed to the axis of the mass analyzer entrance, since the ions are re-directed to move along the mass analyzer entrance axis while still within the multipole ion guide, in these other embodiments. This alternative configuration may provide better ion transport efficiency into the mass analyzer entrance, while reducing complexity and cost, relative to the previously-described tilted linear ion guide configurations.

Further, some embodiments also incorporate a tilted orientation angle between the central axis of an ion guide at the point where it passes through a 'high pressure vacuum partition', and the axis of the ion beam as it enters the ion guide. Such a configuration prevents background particles originating upstream of the ion guide, such as from an ion source or higher pressure region such as a collision cell, or even background particles created at the ion guide entrance region, from passing beyond the vacuum partition, and therefore provides additional assurance that such particles are unable to create noise at a mass analyzer detector. Again, additional electrostatic and/or RF ion guide devices may optionally be employed to ensure maximum ion transport efficiency into the ion guide entrance end, for embodiments that incorporate a tilted linear multipole ion guide, or, alternatively, a bend or curve in an ion guide axis upstream of the vacuum partition, similar to such downstream bends or curves described above, may be incorporated to optimize ion transport efficiency through this upstream portion of the ion guide.

There need not be any particular relation between the direction nor magnitude of this 'upstream tilt angle' between the central axis of an ion guide at the point where it passes through a 'high pressure vacuum partition', and the axis of the ion beam as it enters the ion guide, and the 'downstream tilt angle' defined by the axis of the ion guide at the point where it passes through the 'high pressure vacuum partition', and the mass analyzer entrance axis, in order realize maximum reduction in background noise. However, it typically proves to be more straightforward, and therefore less complex and costly, to configure the 'upstream tilt angle' to be equal in magnitude and opposite in direction to the 'downstream tilt angle'. In this special case, the ion beam directions upstream of the ion guide entrance and downstream of the ion guide exit will be parallel, but displaced laterally (orthogonally to the axial beam direction). Such an arrangement facilitates instrument design and fabrication.

Another special embodiment of the present invention incorporates a multipole ion guide extending continuously through a 'high pressure vacuum partition', where the multipole ion guide is structured with a continuously curving axis, for example, where the ion guide axis extends through a 90 degree segment of a circle. In such an embodiment, the ion guide extends through vacuum partitions while the axis curves.

An even further embodiment of the present invention incorporates an 'S' curve downstream of the 'high pressure vacuum partition', for example, such that the ion guide entrance is coaxial with upstream portion of the ion beam path, and extends straight through the 'high pressure vacuum partition'. An 'S' curve in the ion guide axis downstream of the 'high pressure vacuum partition' then translates the ion guide axis such that the axis of the ion guide at its exit is parallel to, but displaced laterally from, the ion guide axis at its entrance. Hence, the ion beam is guided through the curves to the ion guide exit, and then subsequently into a mass analyzer located downstream, while all background particles created in the vicinity of, and upstream of, the 'pressure vacuum partition' do not negotiate the curves in the ion guide axis and fall to enter the mass analyzer.

Additionally, in all cases, it is typically more advantageous to orient the rods, or poles, of the multipole ion guide such that background particles from an upstream source are more likely to pass through a gap between poles, rather than strike a pole, in order to minimize contamination and consequential electrostatic charging effects.

Furthermore, depending on the vacuum requirements of the mass analyzer and/or detector employed, it may be advantageous to provide one or more additional vacuum partitions between the ion guide exit and the mass analyzer entrance, that is, locate the mass analyzer and detector in a vacuum pumping stage downstream of the vacuum pumping stage in which the exit end of the multipole ion guide is positioned or located, in order to provide an even lower pressure within the space of the mass analyzer and/or detector. In such cases, the multipole ion guide may be extended continuously through such additional vacuum partitions to facilitate ion transport through the partition, or separate ion guide may be employed which then extend continuously through the additional vacuum partitions, instead.

BRIEF DESCRIPTION OF THE DRAWINGS

FIG. 11A shows a cross-sectional view of a quadrupole ion guide arranged symmetrically about a central axis. FIG. 11B shows a cross-sectional view of a quadrupole arrangement of flat pates. FIG. 11C shows a cross-sectional view of eight poles or rods. FIG. 11D shows a cross-sectional view of six poles or rods.

DETAILED DESCRIPTION OF THE PREFERRED EMBODIMENTS

Figure 1:
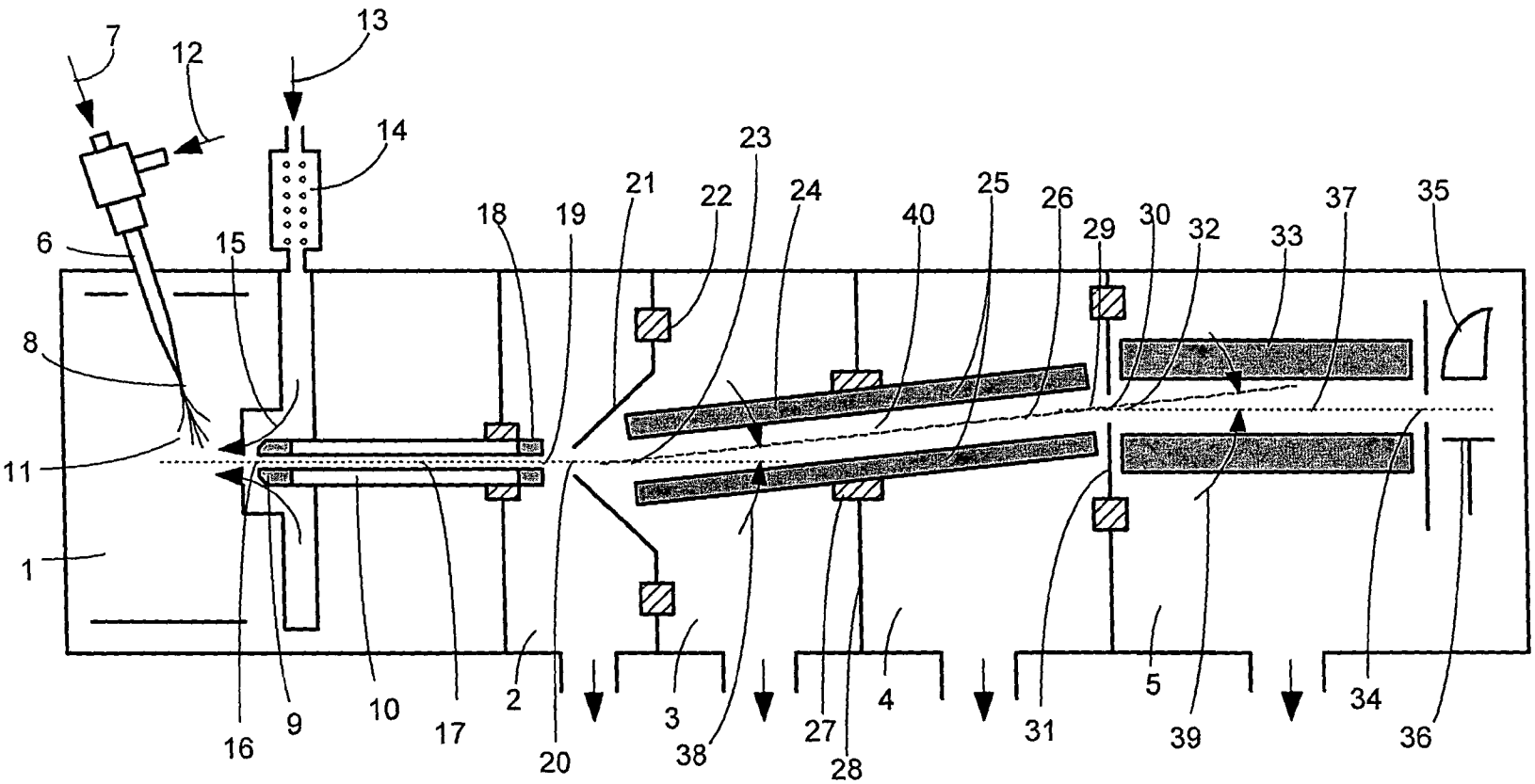
FIG. 1 schematically illustrates an embodiment of the invention in which ions from an ESI ion source are carried into vacuum via a dielectric capillary, pass through a skimmer, and are then transported to a quadrupole mass analyzer by a multipole ion guide that extends through a vacuum partition to provide optimum ion transport, and which is tilted at an angle with respect to the entrance axis of the mass filter in order to prevent background particles from reaching the mass analyzer detector. The tilt in the ion guide relative to the capillary axis also reduces background particles.

A preferred embodiment of the invention is shown in FIG. 1. This embodiment is configured with a conventional Electrospray ionization (ESI) ion source 1 with pneumatic nebulization assist, operating essentially at atmospheric pressure, and mounted to a vacuum system comprising four vacuum pumping stages 2, 3, 4 and 5. The source 1 includes a pneumatic nebulization assisted electrospray probe 6 essentially comprising a liquid sample delivery tube which delivers liquid sample 7 to sample delivery tube end 8. A voltage differential between tube end 8 and the entrance end 9 of capillary vacuum interface 10 is provided by a high voltage DC power supply (not shown). The resulting electrostatic field in the vicinity of sample delivery tube end 8 results in the formation of an electrospray plume 11 from sample liquid 7 emerging from sample delivery tube end 8. In order to enhance nebulization and ionization efficiencies, nebulization gas 12 may be delivered though a nebulization gas tube with an exit opening that is proximal to and, ideally, coaxial with liquid sample delivery tube exit end 8. Counter-current drying gas 13 is heated in drying gas heater 14 and flows past the entrance end 9 of capillary vacuum interface 10 as heated counter-current drying gas 15 to assist with the evaporation of droplets in electrospray plume 11. Sample ions are released from evaporating charged droplets within plume 11, and the ions, along with any remaining charged and uncharged droplets and aerosol particles, are entrained in background gas flowing into capillary vacuum orifice 16. The ions, droplets, and aerosol particles are carried through the capillary 10 bore 17 along with the gas to the capillary exit end 18, and pass through capillary 10 exit orifice 19 into the first vacuum pumping stage 2. Typically, the gas undergoes a supersonic expansion upon exiting the capillary exit orifice 19, and the ions, droplets, and aerosol particles typically acquire velocity distributions that are similar to that of the gas molecules in the expanding gas. Hence, the kinetic energy acquired by any such species will be more or less proportional to the mass of the species. Consequently, droplets and aerosol particles may acquire kinetic energies orders of magnitude larger than the ions of interest.

The ions, droplets, and aerosol particles pass through the orifice 20 of skimmer 21, which is mounted via electrical insulator 22 so that a voltage may be applied to the skimmer to focus charged particles into pumping stage 3 downstream of the skimmer. Ions, droplets, and aerosol particles that pass through the skimmer 21 orifice 20 proceed into the entrance end 23 of linear multipole ion guide 24 along ion beam axis 36, which is essentially the axis of the capillary 10 bore 17, as well as that of skimmer 21 orifice 20. Linear multipole ion guide 24 is a hexapole ion guide comprising six rods 25 arranged symmetrically about a common axis 26. Multipole ion guides comprising four, eight, or more than eight such rods may be used as well. In the embodiment of the invention illustrated in FIG. 1, the linear multipole ion guide 24 axis 26 and the axis 36 are oriented at an angle 37 relative to each other. However, in other embodiments of the invention, the linear multipole ion guide axis 26 may be coaxial with the axis 38 of capillary 10 bore 17 and skimmer 21 aperture 20.

Multipole ion guide 24 rods 25 are supported via insulators 27 and vacuum partition 28 in such a configuration that essentially the only conduit for gas flow between vacuum stages 3 and 4 is the spaces within and between the rods 25. In some constructions, gas may also flow through spaces proximal to and outboard of the rods 25. Hence, multipole ion guide 24 is configured to extend continuously between vacuum pumping stages 3 and 4 while restricting the flow of gas between the vacuum pumping stages 3 and 4. Ions which enter the multipole ion guide 24 at entrance end 23 are guided along the multipole ion guide 24 axis 26 by oscillating RF electric fields generated by alternating RF voltages applied to the rods 25 of multipole ion guide 24. The RF fields within the ion guide 24 prevent ions from passing beyond the rods 25 in directions orthogonal to the ion guide 24 axis 26, while ions move along essentially parallel to the ion guide axis 26 to the ion guide exit end 29.

Ions exit the multipole ion guide 24 through exit end 29 and are directed through aperture 30 in vacuum partition 31. The ions then proceed into the entrance 32 of a quadrupole mass filter 33. Ions are filtered in quadrupole mass filter 33 in according to their mass-to-charge values, and ions which successfully traverse the quadrupole mass filter 33 then pass through the quadrupole mass filter 33 exit aperture 34. These ions are then detected by directing them into detector 35, or by directing them to impact conversion dynode 36, which creates secondary charged particles, which are then directed into detector 35 for detection.

In the embodiment illustrated in FIG. 1, the large majority of background particles, such as charged and uncharged droplets and aerosol particles, energetic ions and neutral species, which may originate in the ion source 1, and/or capillary 10 bore 17, and or in the region between the capillary 10 exit 18 and the skimmer 21 aperture 20, and/or between the skimmer 21 aperture 20 and the ion guide entrance 23, fall to respond, or respond poorly, to the RF fields in the ion guide 24, and proceed more or less along their trajectories past the ion guide 24 entrance 23 to impact surfaces before reaching quadrupole entrance 32 of quadrupole mass filter 33. Such surfaces may include the surfaces of ion guide 24 rods 25, vacuum partition 28, insulators 27, and vacuum partition 31.

Simultaneously, ions which do respond adequately to the RF fields within the ion guide 24 are guided along ion guide axis 26. The background gas pressure within the portion of ion guide 24 that extends into vacuum pumping stage 3 is at a pressure high enough that collisions between the ions and background gas molecules occurs, which reduced the kinetic energies of the ions as they traverse ion guide 24. Generally, the average background gas pressure within this portion of ion guide 33 is at least high enough that the mean free path between collisions between ions and background gas molecules is greater than approximately the distance that the ions must traverse between the ion guide 24 entrance end 23 to the location 40 proximal to where ion guide 24 passes through vacuum partition 28. Hence, ions that are guided along the axis 26 of ion guide 24, and lose kinetic energy due to such collisions, will settle closer to axis 26 as their kinetic energy decreases, due to the action of the well-known, so-called 'pseudopotential' well that is formed by the RF fields within the ion guide 24 along ion guide 24 axis 26.

Once the ions move through ion guide 24 into vacuum pumping stage 4, which is at a lower background gas pressure such that collisions between ions and background gas molecules essentially do not occur, the ions move from the vicinity of vacuum partition 28 to the ion guide 24 exit end 29 without any significant collisions with background gas molecules. Hence, the last location in the apparatus illustrated in FIG. 1 at which background particles may be created by collisions between ions and background gas molecules is location 40 within ion guide 24 proximal to and downstream of vacuum partition 28.

As the ions reach the exit end 29 of ion guide 24, they are directed through aperture 30 in vacuum partition 31, and then into quadrupole mass filter 33 through quadrupole mass filter entrance 32, while the ion beam direction is changed through angle 39 from axis 26 of ion guide 24 to axis 37 of mass filter 33. Any background particles that had been created at location 40, or any background particles which may originate upstream of location 40, may have a line-of-sight trajectory through quadrupole entrance 32, but will not have line-of-sight trajectory past aperture 34 to the detector 35 or any surface in the region of detector 35, due to the angle 39 between the axis 26 of ion guide 24 and the axis 37 of mass analyzer 33, in combination with the distance between mass analyzer 33 entrance 32 and the location 40. Hence, such background particles are prevented from creating background particle noise by impacting detector 35 or conversion dynode 36 or surrounding surfaces in the region of detector 35 and conversion dynode 36.

Such background particles may include, for example, any background particles emerging through capillary 10 exit orifice 19, or background particles created between capillary 10 exit orifice 19 and ion guide 24 entrance 23, which may have trajectories that were skewed relative to capillary 10 bore 17 axis 16, such that some of them may have line-of-sight from regions upstream of the ion guide 24 entrance 23 through mass analyzer 33 entrance 32. Alternatively, other embodiments of the invention may be configured with angle 38 equal to zero, in which case many more of these background particles would be expected to pass through mass analyzer 33 entrance 32. In either configuration, the angle 39 between the axis 26 of ion guide 24 and the axis 37 of mass analyzer 33, in combination with the distance between mass analyzer 33 entrance 32 and the locations upstream of ion guide 24 entrance 23 where such background particles may be created, prevents any such particles from passing through aperture 34 to the detector 35 or any surface in the region of detector 35.

Other background particles that are prevented from reaching detector 35 or surrounding surfaces, according to the invention, include energetic neutral species that may be created by collisions between ions and background gas molecules within the portion of ion guide 24 that is located in higher gas pressure regions where such collisions occur. According to the invention, the creation of such background particles in regions such as in vacuum pumping stage 3 and in regions proximal to vacuum partition 28 up to location 40, are prevented from having line-of-sight trajectory paths from their point of creation through to the detector 35, or to regions surrounding detector 35, due to the angle 39 between the axis 26 of ion guide 24 and the axis 37 of mass analyzer 33, in combination with the distance between mass analyzer 33 entrance 32 and the locations within ion guide 24 upstream of location 40 where such background particles may be created. Consequently, according to the invention, such background particles will also be prevented from creating background particle noise by impacting detector 35 or conversion dynode 36 or surrounding surfaces in the region of detector 35 and conversion dynode 38.

Hence, in the embodiment of the invention illustrated in FIG. 1, a linear multipole ion guide is configured to uniquely provide improved ion transport through a vacuum partition, while simultaneously reducing background particle noise caused by background particles created in collisions between ions and background gas molecules, as well as background particles originating with an ion source.

Figure 2:
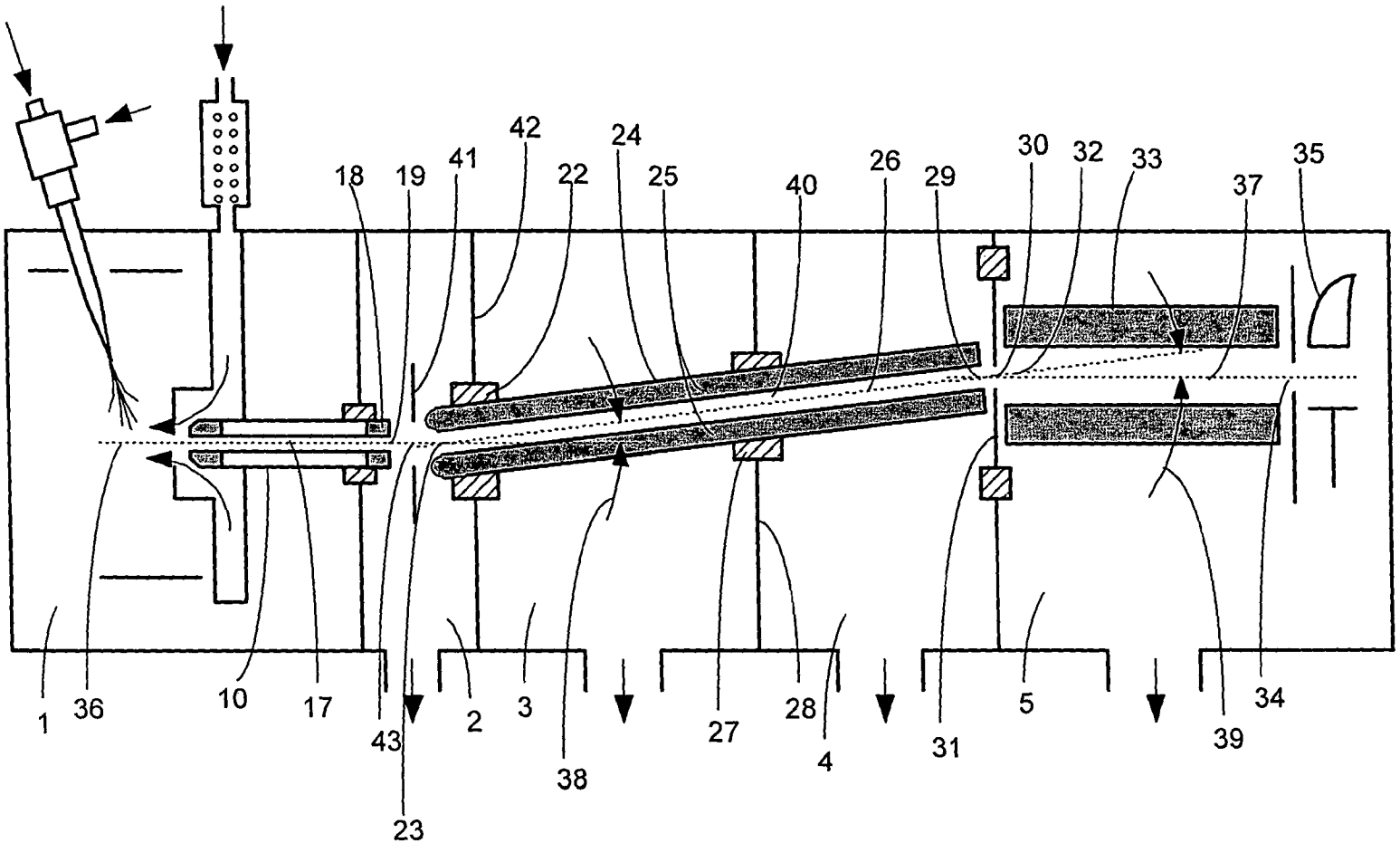
FIG. 2 schematically illustrates an embodiment of the invention in which ions from an ESI ion source are carried into vacuum via a dielectric capillary, pass through an aperture lens and then directly into a multipole ion guide that extends continuously through two vacuum partitions, to transport the ions to a quadrupole mass analyzer, where the ion guide is tilted at an angle with respect to the entrance axis of the mass filter in order to prevent background particles from reaching the mass analyzer detector.

An alternative embodiment of the invention is illustrated in FIG. 2, where elements corresponding to the same functional elements as in FIG. 1 are labeled the same. FIG. 2 illustrates an embodiment of the invention in which a linear multipole ion guide 24 extends continuously through two vacuum partitions 42 and 28, from the first vacuum stage 2 in which the capillary 10 exit orifice 19 is located, through the second vacuum pumping stage 3 and into the third vacuum pumping stage 4. In this embodiment, the skimmer 21 of FIG. 1 has been eliminated, and a flat lens electrode 41 with aperture 43 is positioned between capillary 10 exit orifice 19 and ion guide 24 entrance 23. This arrangement allows improved ion transport efficiency between the capillary 10 exit orifice 19 and ion guide 24 entrance 23 than the configuration of FIG. 1, due primarily to the closer proximity allowed by the configuration of FIG. 2, compared to that of FIG. 1, between capillary 10 exit orifice 19 and ion guide 24 entrance 23. The ions are re-directed by the RF fields within ion guide 24 to move along ion guide 24 axis 26 rather than capillary 10 axis 36 upon entering on guide 24 entrance 23. Again, background particles originating upstream of location 40, are prevented from having line-of-sight trajectory paths from their point of creation through to the detector 35, or to regions surrounding detector 35, due to the angle 39 between the axis 26 of ion guide 24 and the axis 37 of mass analyzer 33, in combination with the distance between mass analyzer 33 entrance 32 and any locations upstream of location 40 where background particles may be created. Consequently, all background particles will be prevented from impacting detector 35, or conversion dynode 36, or surrounding surfaces in the region of detector 35 and conversion dynode 36, and are thereby are prevented from creating background particle noise according to this embodiment of the invention.

Figure 2A:
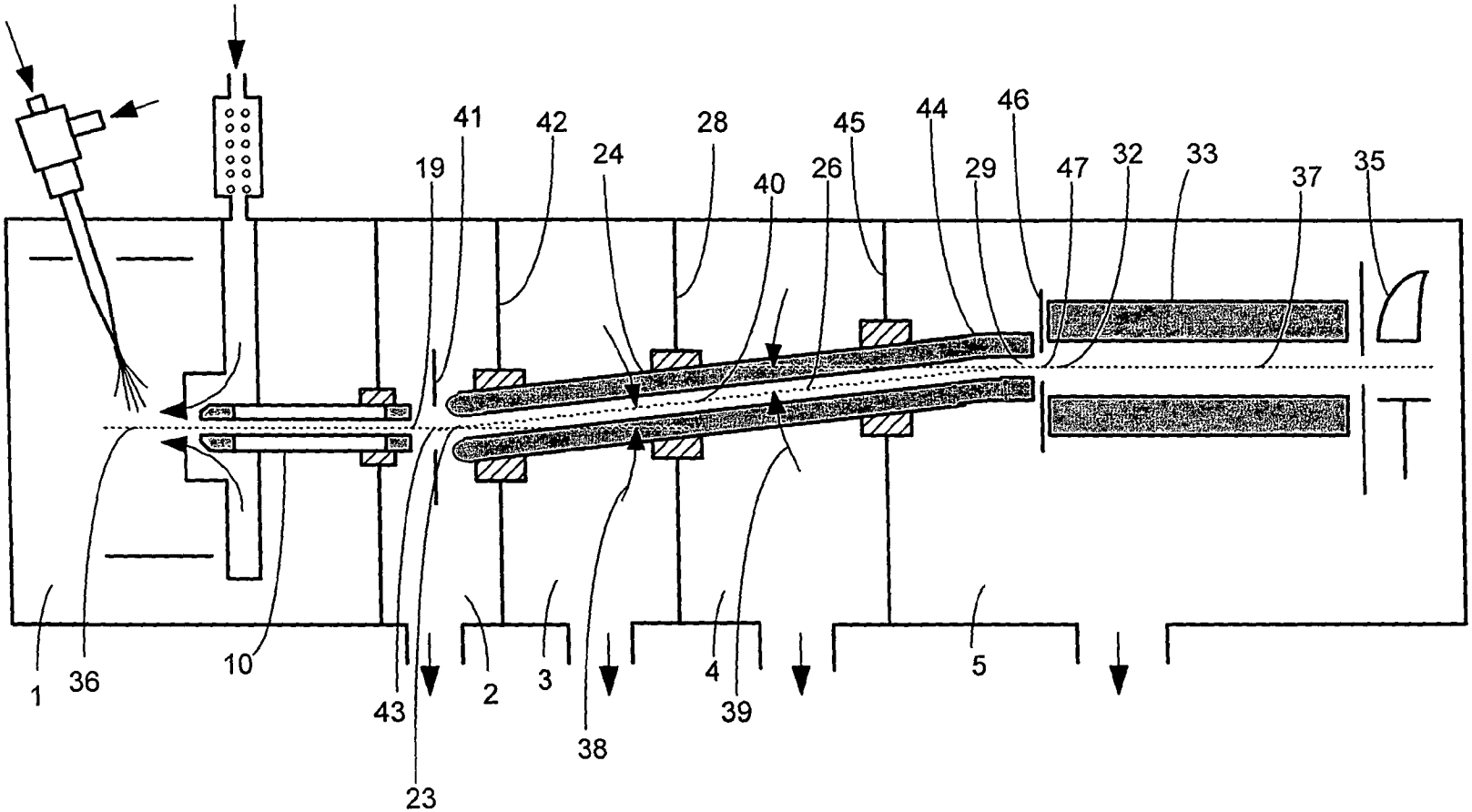
FIG. 2A schematically illustrates an embodiment of the invention in which ions from an ESI ion source are carried into vacuum via a dielectric capillary, pass through an aperture lens and then directly into a multipole ion guide that extends continuously through three vacuum partitions, to transport the ions to a quadrupole mass analyzer, where the ion guide is tilted at an angle with respect to the entrance axis of the mass filter, and also includes a bend in the ion guide, in order to prevent background particles from reaching the mass analyzer detector.

Alternative embodiments of the invention may incorporate additional features, including ion guides which extend continuously into more than three vacuum pumping stages, as well as ion guides which incorporate a bend or curved section along the ion guide axis. Such features are illustrated in the embodiment of the invention shown in FIG. 2A, which illustrates a four-stage vacuum pumping system, in which, similar to the configuration of FIG. 2, the entrance 23 of multipole ion guide 24 begins in the first vacuum pumping stage 2. Ions flowing from capillary 10 exit orifice 19 pass through aperture 43 in lens electrode 41 and into entrance 23 of multipole ion guide 24. The ions are re-directed by the RF fields within ion guide 24 to move along ion guide 24 axis 26 rather than capillary 10 axis 36 upon entering ion guide 24 entrance 23. As in the embodiment of FIG. 2, ion guide 24 is configured to extend continuously from the first vacuum pumping stage 2, through vacuum partition 42, the second vacuum pumping stage 3, and through vacuum partition 28. However, in the configuration illustrated in FIG. 2A, ion guide 24 also extends continuously through the third vacuum pumping stage 4, through the vacuum partition 45, and into vacuum pumping stage 5, in which the mass analyzer 33 and detector 35 are located. Once the ion guide 24 has extended into vacuum pumping stage 5, ion guide 24 is configured with a bend 44 in the ion guide axis 26, where the bend is configured with a bend angle that is equal to the angle 39 between the ion guide 24 axis 26 along the portion of ion guide 24 upstream of the bend 44 and the mass analyzer axis 37, so that the ion guide axis 26 of the portion of the ion guide 24 downstream of the bend 44 is coaxial with the mass analyzer axis 37. Hence, the bend 44 in the ion guide 24 may provide better ion transmission as ions are re-directed through angle 39 from their direction along ion guide 24 axis 26 upstream of the bend 44 and mass analyzer axis 37, relative to the configuration illustrated in FIG. 2. Again, background particles originating upstream of location 40, are prevented from having line-of-sight trajectory paths from their point of creation through to the detector 35, or to regions surrounding detector 35, due to the angle 39 between the axis 26 of ion guide 24 and the axis 37 of mass analyzer 33, in combination with the distance between mass analyzer 33 entrance 32 and any locations upstream of location 40 where background particles may be created. Consequently, all background particles will be prevented from impacting detector 35, or conversion dynode 36, or surrounding surfaces in the region of detector 35 and conversion dynode 36, and are thereby are prevented from creating background particle noise according to this embodiment of the invention.

Figure 3:
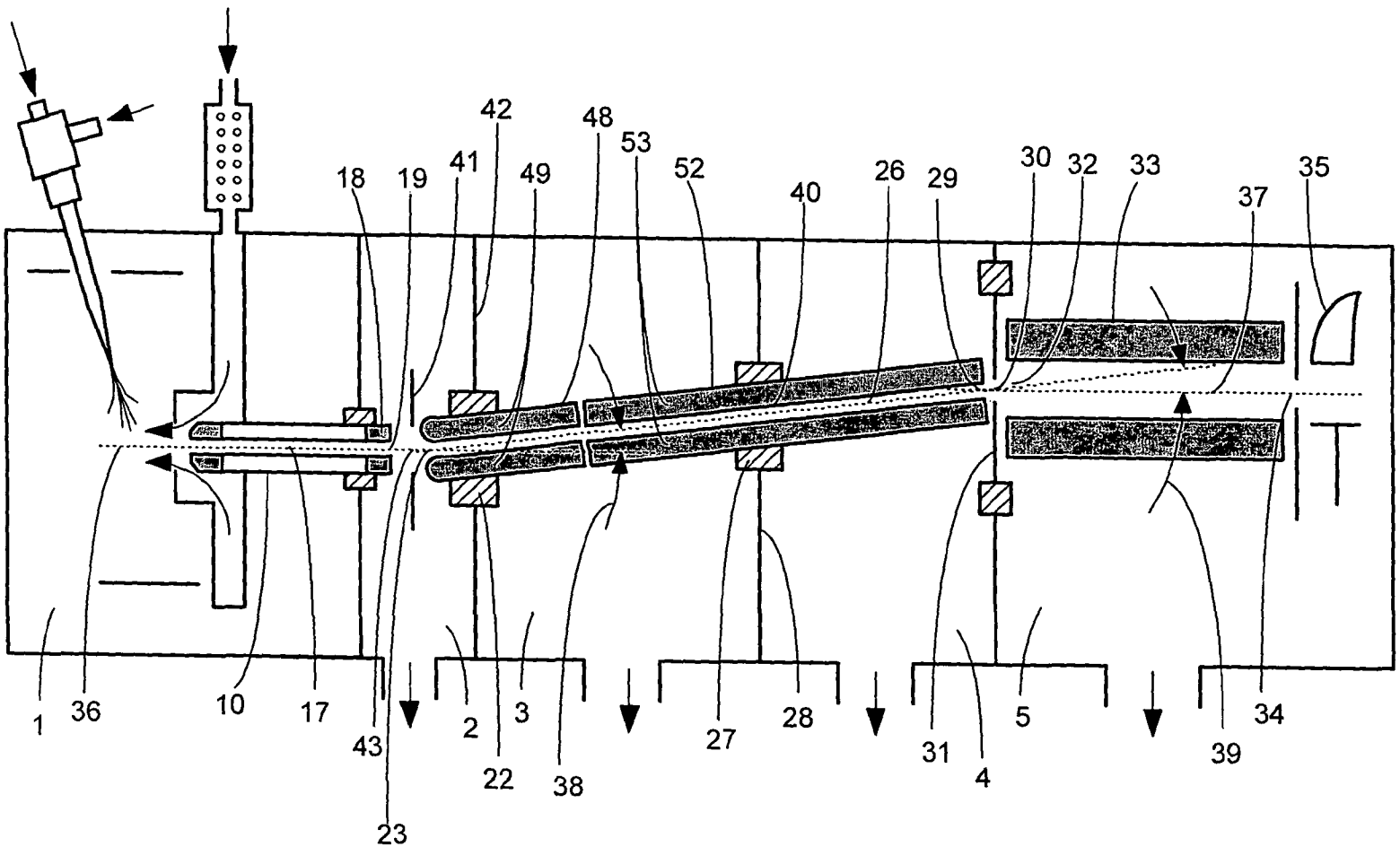
FIG. 3 schematically illustrates an embodiment of the invention in which ions from an ESI ion source are carried into vacuum via a dielectric capillary, pass through an aperture lens and then directly into a multipole ion guide segment that extends continuously through one vacuum partition. A second segment then transports the ions through a second vacuum partition to a quadrupole mass analyzer. The two segments are coaxial, and they are tilted at an angle with respect to the entrance axis of the mass filter, in order to prevent background particles from reaching the mass analyzer detector.

An alternative modification of the embodiment of FIG. 2 is shown in FIG. 3. FIG. 3 illustrates that the invention may be configured similar to the embodiment of FIG. 2, the primary difference being that a tilted linear multipole ion guide is segmented into two separate and independent ion guide segments along a common tilted ion guide axis 26. The first ion guide segment 48 is configured with ion guide rods 49 and extends continuously from the ion guide entrance 23 in the first pumping stage 2, through vacuum partition 42, and into vacuum pumping stage 3, where the first ion guide segment ends at ion guide segment 48 exit end 50. After a small gap 51, the second ion guide segment 52 extends continuously from the on guide segment 52 entrance end 54 in vacuum stage 3, through vacuum partition 28 into vacuum pumping stage 4.

Ions exiting capillary 10 exit orifice 19 pass into ion guide segment 49 entrance end 23 and are guided by RF fields within ion guide segment 49, through vacuum partition 42 to ion guide segment 49 exit end 50. From ion guide segment 49 exit end 50, the ions are directed across the gap 51 into the entrance end 54 of ion guide segment 52. The RF fields within ion guide segment 52 act to guide the ions to ion guide segment 52 exit end 29. The ions are then directed through orifice 30 into mass analyzer entrance 32 for mass analysis and detection with detector 35.

Because the ion guide segments 48 and 52 are operated independently, they may have different RF and DC voltages applied. In particular, they may have the same RF voltages applied, but different DC offset voltages applied to each of them, which results in acceleration of ions from ion guide segment 49 exit end 50, across gap 51, and into the entrance end of ion guide segment 52. The vacuum stage 3 in which gap 51 is located has a background gas pressure that is high enough that collisions occur between ions and background gas molecules. If the acceleration of ions across gap 51 is strong enough, then collisions between ions and background gas molecules will result in collision induced dissociation (CID) of the ions into fragment ions and neutrals. The fragment ions, and any remaining 'parent' ions, will be guided through ion guide 52, and their kinetic energy, which may have been increased as a result of accelerating across gap 51, will be damped by subsequent collisions with background gas molecules as the ions move between gap 51 and location 40, after which the background gas pressure is low enough that collisions between ions and background gas molecules do not occur. Again, background particles originating upstream of location 40, in this case, in particular, energetic neutral species created as a result of the CID collisions, are prevented from having line-of-sight trajectory paths from their point of creation through to the detector 35, or to regions surrounding detector 35, due to the angle 39 between the axis 26 of ion guide 24 and the axis 37 of mass analyzer 33, in combination with the distance between mass analyzer 33 entrance 32 and any locations upstream of location 40 where background particles may be created. Consequently, all background particles will be prevented from impacting detector 35, or conversion dynode 36, or surrounding surfaces in the region of detector 35 and conversion dynode 36, and are thereby are prevented from creating background particle noise according to the invention.

Figure 4:
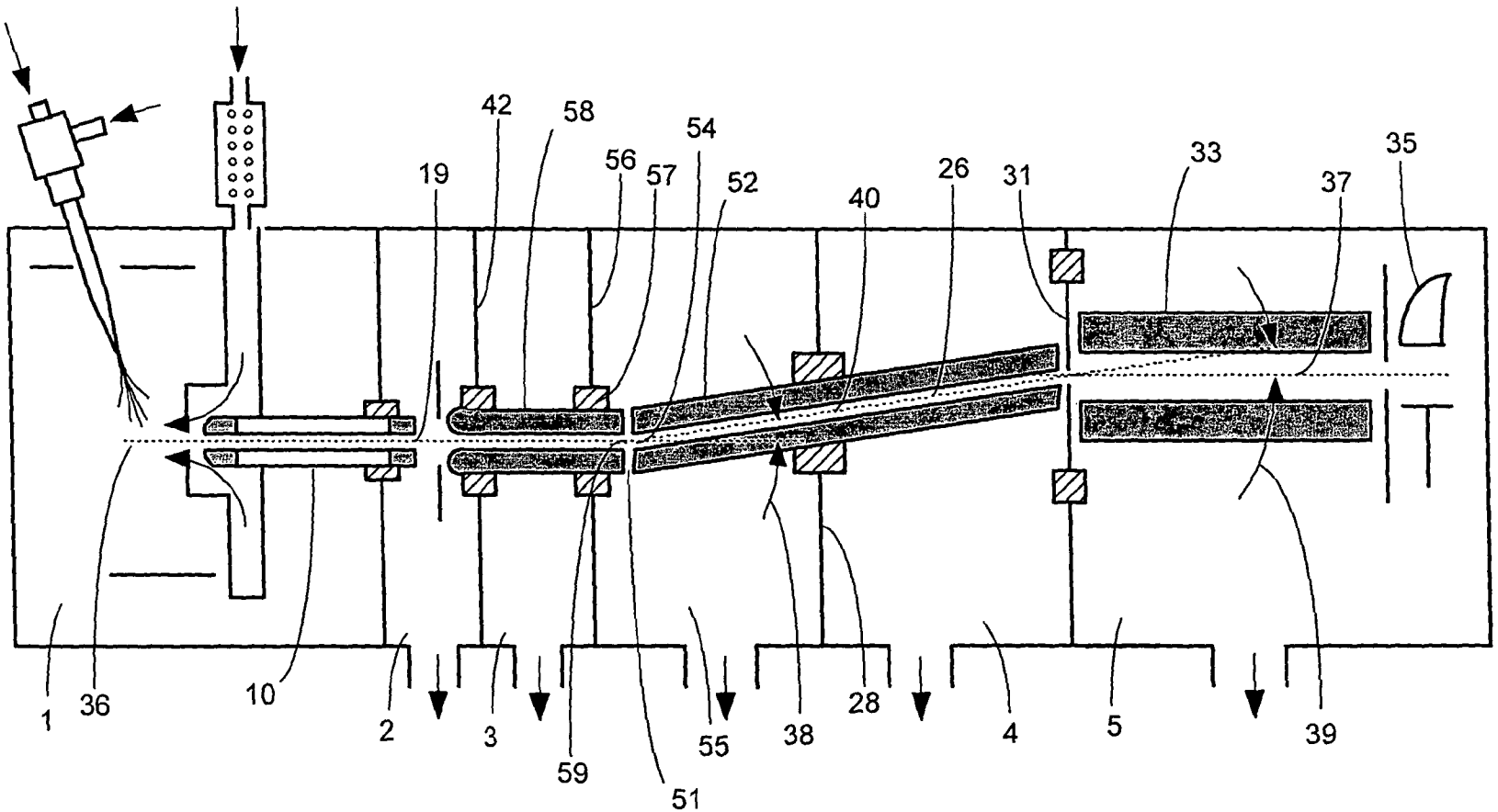
FIG. 4 schematically illustrates an embodiment of the invention in which ions from an ESI ion source are carried into vacuum via a dielectric capillary, pass through an aperture lens and then directly into a first multipole ion guide segment that extends continuously through two vacuum partitions. A second segment then transports the ions through a second vacuum partition to a quadrupole mass analyzer. The first segments is coaxial with the capillary axis, but the second segment is tilted at an angle with respect to the entrance axis of the mass filter, in order to prevent background particles from reaching the mass analyzer detector.

FIG. 4 illustrates a modification of FIG. 3, in which the first ion guide segment 48 in FIG. 3 is oriented coaxial with capillary 10 axis 36, and extends not only through the vacuum partition 42 between the first vacuum pumping stage 2 and the second vacuum pumping stage 3, but also extends through an additional vacuum partition 56 (compared to the embodiment of FIG. 3) that divides the vacuum pumping stage 3 of FIG. 3 into an additional vacuum pumping stage, which is shown in FIG. 4 as vacuum pumping stage 55. Ion guide segment 58 exit end 59 is positioned in the third vacuum pumping stage 55 in FIG. 4. The second ion guide segment 52 is then oriented at an angle 38 with respect to the axis 36, and the configuration of this embodiment is the same as in FIG. 3 downstream of the gap 51.

The advantage of the embodiment shown in FIG. 4, relative to the embodiment of FIG. 3, is that ions that enter the first ion guide segment 58 along axis 38 may proceed along ion guide segment 58 and experience collisional cooling of ion kinetic energy before their beam direction is re-directed from the capillary 10 axis 36 to the ion guide segment 52 axis 26. Cooling the ion's kinetic energy improves the efficiency with which the RF fields within an ion guide are able to re-direct the ions' beam path, because the effectiveness of a particular RF field strength for guiding or re-directing ions decreases as the kinetic energy of the ions increases. Hence, allowing the ions' kinetic energy to dampen in collisions with background gas molecules in vacuum stage 3 of FIG. 4 ensures better capture and re-direction efficiency with the ion guide segment 58 of FIG. 4, relative to the ion guide segment 48 of FIG. 3, for example. This becomes particularly important for higher mass-to-charge ions, which have kinetic energies roughly proportional to their mass as they exit the capillary 10 exit orifice 19 with the velocity distribution similar to that of the expanding gas. Also, as in the embodiment of FIG. 3, the RF and DC voltages applied to the ion guide segments 58 and 52 may be different, allowing CID to be performed similarly to the embodiment of FIG. 3 as discussed above.

Figure 5:
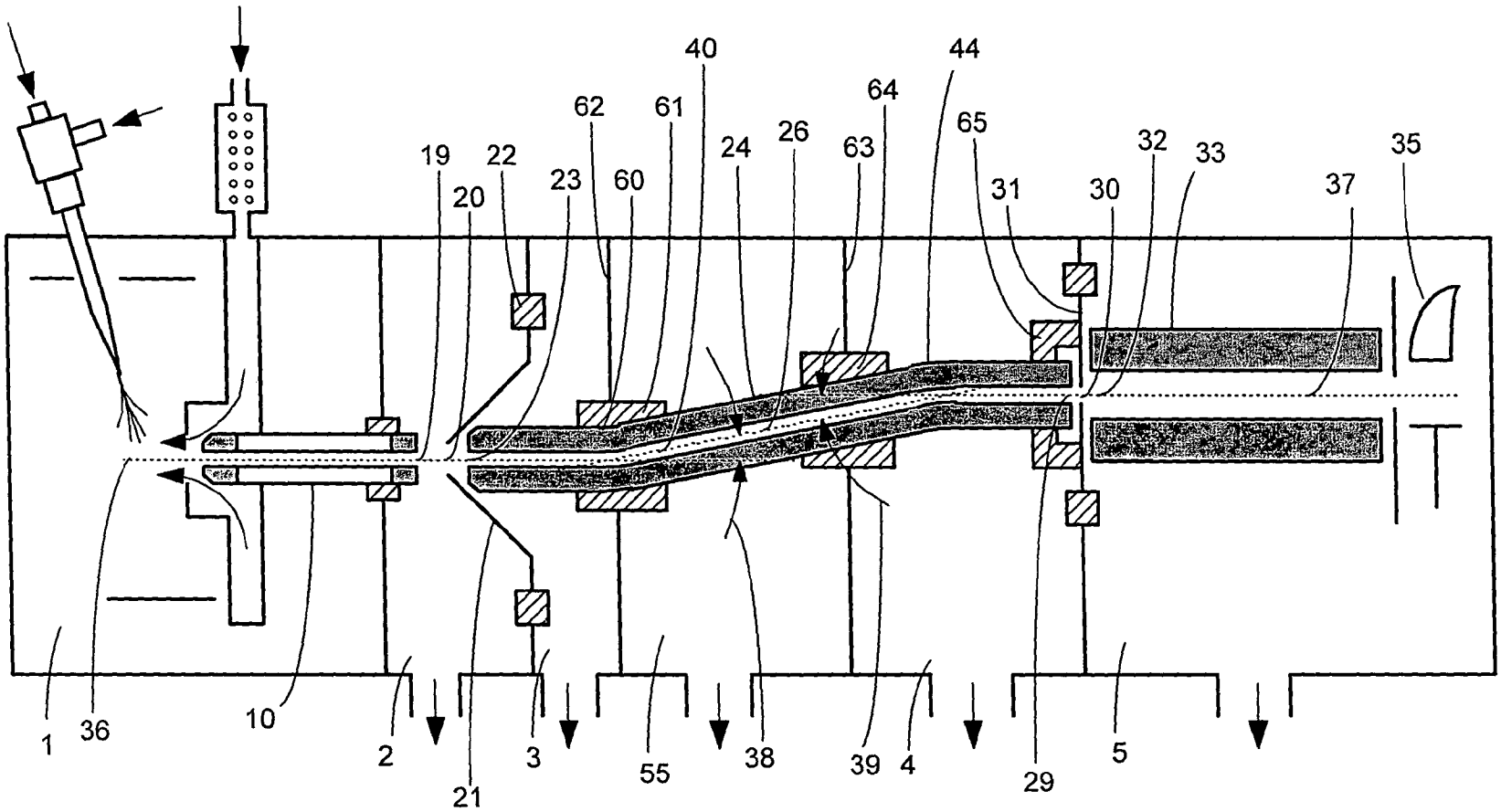
FIG. 5 schematically illustrates an embodiment of the invention in which ions from an ESI ion source are carried into vacuum via a dielectric capillary, pass through a skimmer, and are then transported to a quadrupole mass analyzer by a multipole ion guide that extends through three vacuum partitions to provide optimum ion transport. The ion guide contains two bends along its length, such that entrance portion of the ion guide is coaxial with the capillary axis, the central portion is at an angle relative to the first portion, and the exit portion is coaxial with the entrance axis of the mass filter, thereby preventing background particles from reaching the mass analyzer detector.

Another alternative embodiment of the present invention is illustrated in FIG. 5. This embodiment is configured with an ion guide 24 that is configured with two bends 60 and 44 in the ion guide 24 axis 26 such that the ion guide 24 axis 26 at the ion guide 24 entrance end 23 is coaxial with capillary 10 axis 36, and the ion guide 24 axis 26 at the ion guide 24 exit end 29 is coaxial with mass analyzer 33 axis 37. Hence, the ion beam direction may be changed from capillary 10 axis 36 to the ion guide 24 axis 26 at the ion guide 24 entrance end 23, and from the ion guide 24 axis 26 at the ion guide 24 exit end 29 to the mass analyzer 33 axis 37, while the ions remain within the guiding RF fields of the ion guide 24, thereby ensuring efficient ion transport during such changes in beam direction. Also, the portion of the ion guide 24 between the ion guide entrance 23 and the bend 60, which is coaxial with the capillary 10 axis 36, allows ion kinetic energy to cool before the beam is re-directed at bend 44, thereby further ensuring efficient ion transport through the bend 44 even for higher mass ions. As discussed above, such higher mass ions will have higher kinetic energy upon exiting through capillary 10 exit orifice 19, making them more difficult to re-direct with RF fields prior to collisional cooling of their kinetic energy.

Again, background particles originating upstream of location 40, are prevented from having line-of-sight trajectory paths from their point of creation through to the detector 35, or to regions surrounding detector 35, due to the angle 39 between the axis 26 of ion guide 24 between the ion guide bends 44 and 60, and the axis 37 of mass analyzer 33, in combination with the distance between mass analyzer 33 entrance 32 and any locations upstream of location 40 where background particles may be created. Consequently, all background particles will be prevented from impacting detector 35, or conversion dynode 36, or surrounding surfaces in the region of detector 35 and conversion dynode 36, and are thereby are prevented from creating background particle noise according to this embodiment of the invention.

For the sake of lower manufacturing cost and more straightforward instrument design, the angles 38 and 39 may be arranged to be essentially equal and opposite in direction, thereby configuring the capillary 10 axis 19 to be parallel to the mass analyzer 33 axis 37. Also, the embodiment of FIG. 5 is shown to be configured with an insulator 65 supporting the exit end 29 of ion guide 24 and increasing the gas flow restriction between vacuum pumping stages 4 and 5, in addition to the gas flow restriction provided by aperture 30 in vacuum partition 31.

Figure 5A:
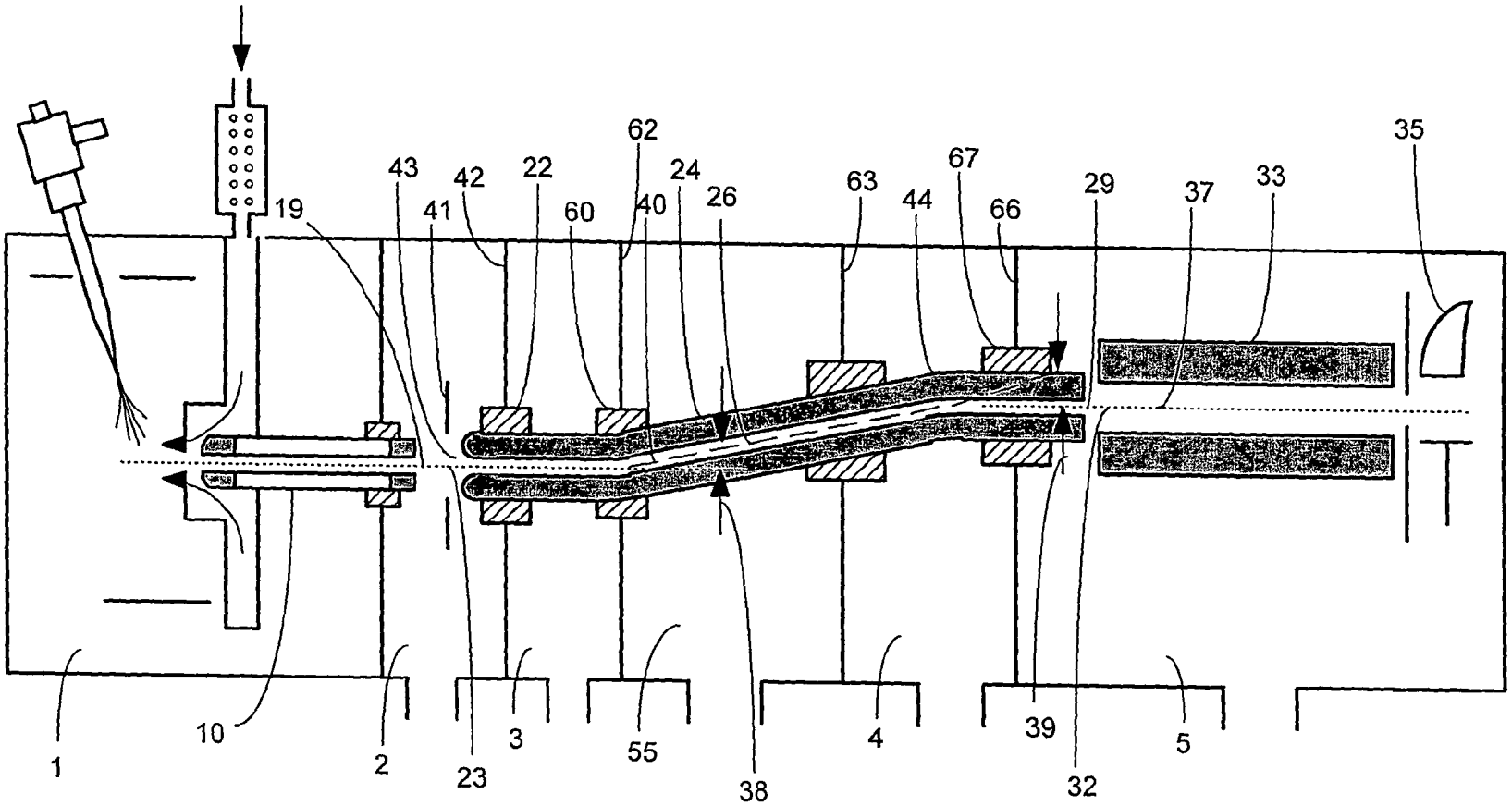
FIG. 5A schematically illustrates an embodiment of the invention in which ions from an ESI ion source are carried into vacuum via a dielectric capillary, pass through an aperture lens and then directly into a multipole ion guide that extends continuously through four vacuum partitions to provide optimum ion transport to a quadrupole mass analyzer. The ion guide contains two bends along its length, such that entrance portion of the ion guide is coaxial with the capillary axis, the central portion is at an angle relative to the first portion, and the exit portion is coaxial with the entrance axis of the mass filter, thereby preventing background particles from reaching the mass analyzer detector.

Additional modifications of the embodiment of the invention shown in FIG. 5 may be incorporated. For example, the embodiment of the invention illustrated in FIG. 5A shows an ion guide also configured with two bends 60 and 44, as in FIG. 5, but where the skimmer 21 is removed, and is replaced by vacuum partition 42 through which ion guide 24 extends such that ion guide 24 entrance 23 is located in the first vacuum pumping stage 2, while ion guide 24, along with ion guide 24 insulator 22, forms the restricted conduit for gas flow between vacuum pumping stages 2 and 3. Also, flat lens electrode 41 with aperture 43 is positioned between capillary 10 exit orifice 19 and ion guide 24 entrance 23. This arrangement allows better ion transport efficiency between the capillary 10 exit orifice 19 and ion guide 24 entrance 23 than the skimmer 21 configuration of FIG. 5, due primarily to the closer proximity allowed by the configuration of FIG. 5A, compared to that of FIG. 5, between capillary 10 exit orifice 19 and ion guide 24 entrance 23. Further, the insulator support 65 and vacuum partition 31 with aperture 30 of the embodiment of FIG. 5 is reconfigured in FIG. 5A. As vacuum partition 66 and insulator 67, which supports ion guide 24 proximal to ion guide exit end 29, and, together with ion guide 24, forms the gas flow restriction between vacuum pumping stages 4 and 5.

Again, background particles originating upstream of location 40, are prevented from having line-of-sight trajectory paths from their point of creation through to the detector 35, or to regions surrounding detector 35, due to the angle 39 between the axis 26 of ion guide 24 between the ion guide bends 44 and 60, and the axis 37 of mass analyzer 33, in combination with the distance between mass analyzer 33 entrance 32 and any locations upstream of location 40 where background particles may be created. Consequently, all background particles will be prevented from impacting detector 35, or conversion dynode 36, or surrounding surfaces in the region of detector 35 and conversion dynode 36, and are thereby are prevented from creating background particle noise according to this embodiment of the invention.

Figure 6:
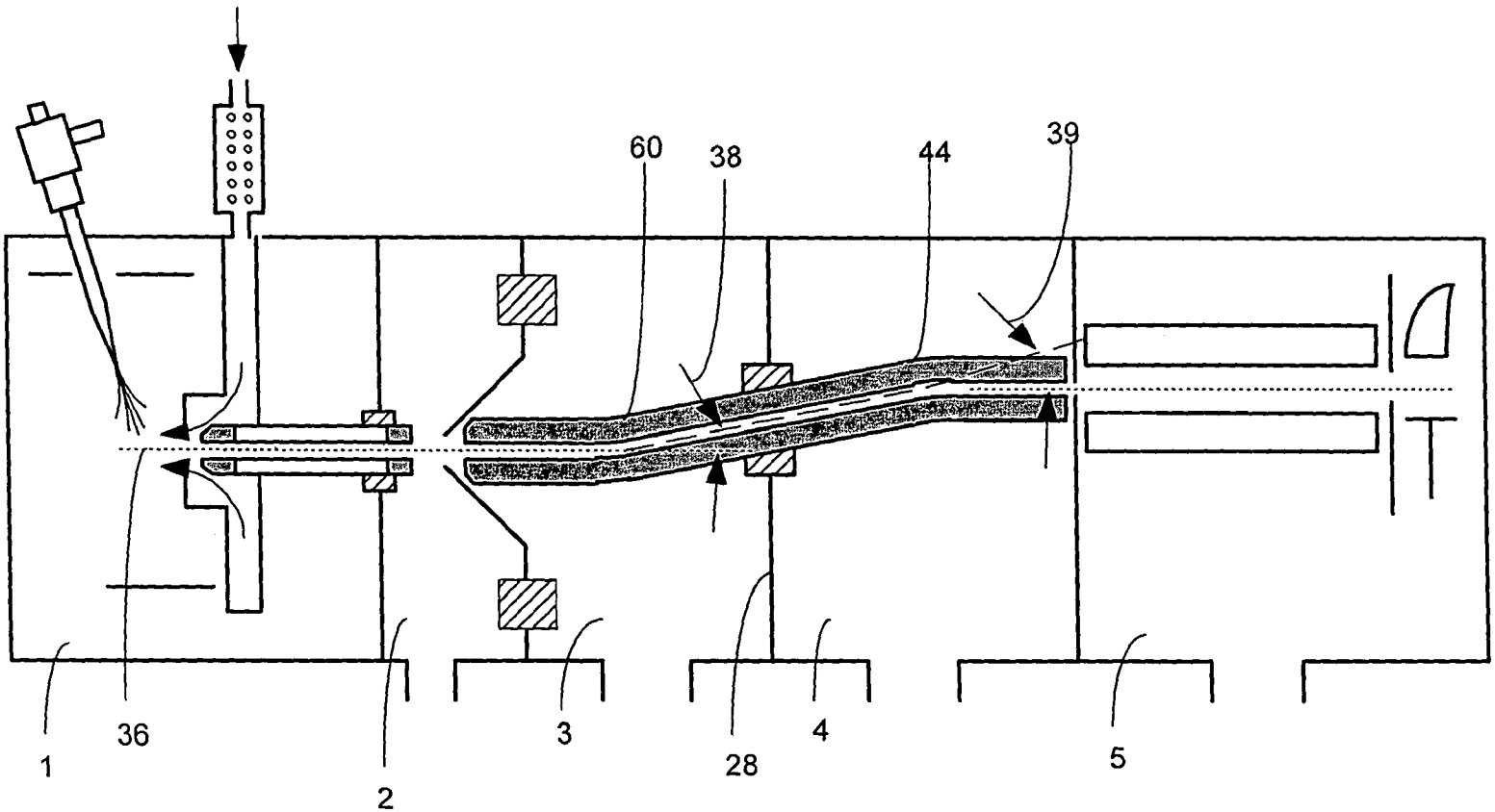
FIG. 6 schematically illustrates an embodiment of the invention in which ions from an ESI ion source are carried into vacuum via a dielectric capillary, pass through a skimmer, and then into a multipole ion guide that extends continuously through one vacuum partitions to provide optimum ion transport to a quadrupole mass analyzer. The ion guide contains two bends along its length, such that entrance portion of the ion guide is coaxial with the capillary axis, the central portion is at an angle relative to the first portion, and the exit portion is coaxial with the entrance axis of the mass filter, thereby preventing background particles from reaching the mass analyzer detector.

An additional embodiment of the invention is depicted in FIG. 6, which illustrates essentially the configuration that was shown in FIG. 1, but where the ion guide 24 is replaced by one which incorporates two bends 44 and 60 similar to the bends 44 and 60 in the ion guide 24 of FIGS. 5 and 5A. Because ion guide 24 of FIG. 6 extends only through one vacuum partition 28, the construction of this embodiment may be less costly and more straightforward to manufacture and assemble than the embodiments shown in FIGS. 5 and 5A. However, the background gas pressure in vacuum stage 5 where the mass analyzer is located may not be as low as in the embodiments of FIGS. 5 and 5A.

Figure 7:
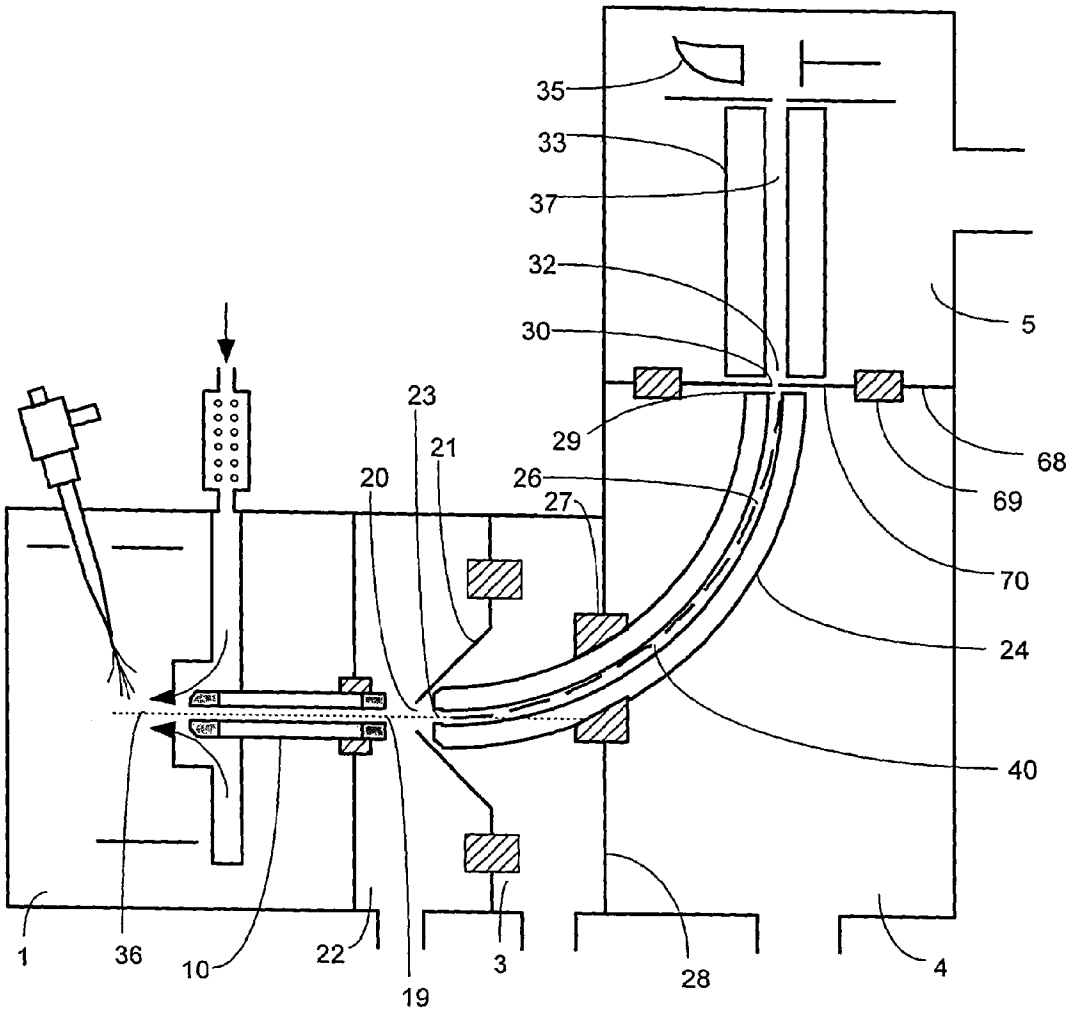
FIG. 7 schematically illustrates an embodiment of the invention in which ions from an ESI ion source are carried into vacuum via a dielectric capillary, pass through a skimmer, and then into a multipole ion guide that extends continuously through one vacuum partitions to provide optimum ion transport to a quadrupole mass analyzer. The ion guide is configured with a continuous curve along its length, such that entrance portion of the ion guide is coaxial with the capillary axis, and the exit portion is coaxial with the entrance axis of the mass filter, and at an angle of ninety degrees with respect to the axis of the capillary, thereby preventing background particles from reaching the mass analyzer detector.

All of the embodiments of the invention discussed above have incorporated an ion guide where at least one portion of the ion guide is configured as a linear ion guide portion. Alternatively, according to the present invention, the entire ion guide may be configured completely curved. For example, FIG. 7 illustrates another embodiment of the present invention which incorporates a multipole ion guide 24 with a central axis 26 that follows the path of a ninety-degree segment of a circle, and which also extends through a vacuum partition 28. Ions exiting capillary 10 orifice 19 pass through skimmer 21 aperture 20 and into the entrance 23 of curved ion guide 24. The axis of curved ion guide 24 is configured to be coaxial with axis 36 of capillary 10 at the entrance 23 of curved ion guide 24. The background gas pressure in vacuum stage 2 is high enough that collisions between ions and background gas molecules occur as ions traverse the ion guide within this vacuum stage. However, the background gas pressure within vacuum stage 4 is low enough that collisions between ions and background gas molecules essentially do not occur as ions traverse the ion guide 24 within the vacuum stage 4, at least downstream of location 40. In the configuration of FIG. 7, background particles originating upstream of location 40 do not have line-of-sight trajectories that allow them to pass through aperture 30 in lens 70, which forms part of vacuum partition 68 along with insulator 69. Consequently, according to this embodiment of the invention, all background particles will be prevented from impacting detector 35, or conversion dynode 36, or surrounding surfaces in the region of detector 35 and conversion dynode 36, and are thereby are prevented from creating background particle noise.

Figure 7A:
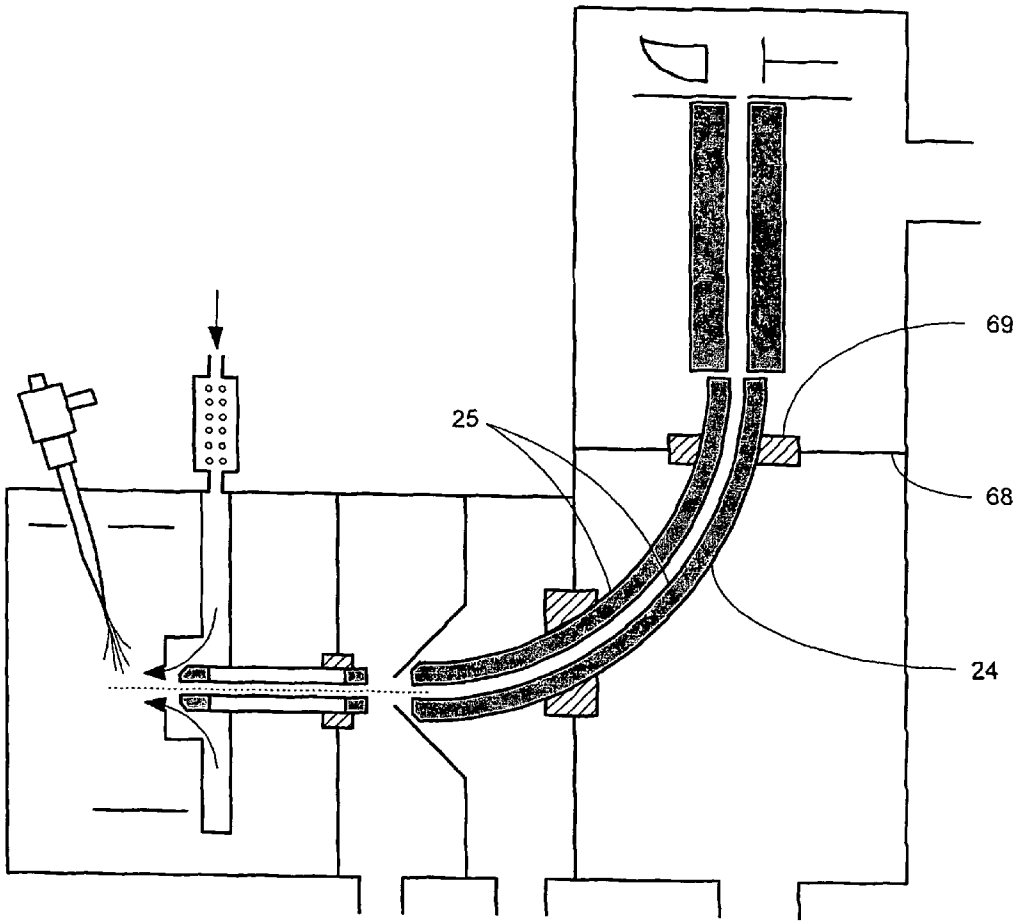
FIG. 7A schematically illustrates an embodiment of the invention in which ions from an ESI ion source are carried into vacuum via a dielectric capillary, pass through a skimmer, and then into a multipole ion guide that extends continuously through two vacuum partitions to provide optimum ion transport to a quadrupole mass analyzer. The ion guide is configured with a continuous curve along its length, such that entrance portion of the ion guide is coaxial with the capillary axis, and the exit portion is coaxial with the entrance axis of the mass filter, and at an angle of ninety degrees with respect to the axis of the capillary, thereby preventing background particles from reaching the mass analyzer detector.

An alternative arrangement to the embodiment illustrated in FIG. 7 is shown in FIG. 7A. The difference between the embodiments of FIGS. 7 and 7A is that lens 70 of FIG. 7 is removed, and curved ion guide 24 extends continuously through vacuum partition 68, where insulator 69 now not only forms part of the vacuum partition, but also provides support for the rods 25. Hence, the conductance restriction to gas flow that had been provided by aperture 30 in lens 70, in FIG. 7, is now provided by the limited open spaces within, between, and otherwise proximal to the rods 25 of ion guide 24. This configuration may provide better ion transmission from the ion guide 24 exit 29 into the mass analyzer 33 entrance 32 due to the elimination of aperture 30.

Figure 8:
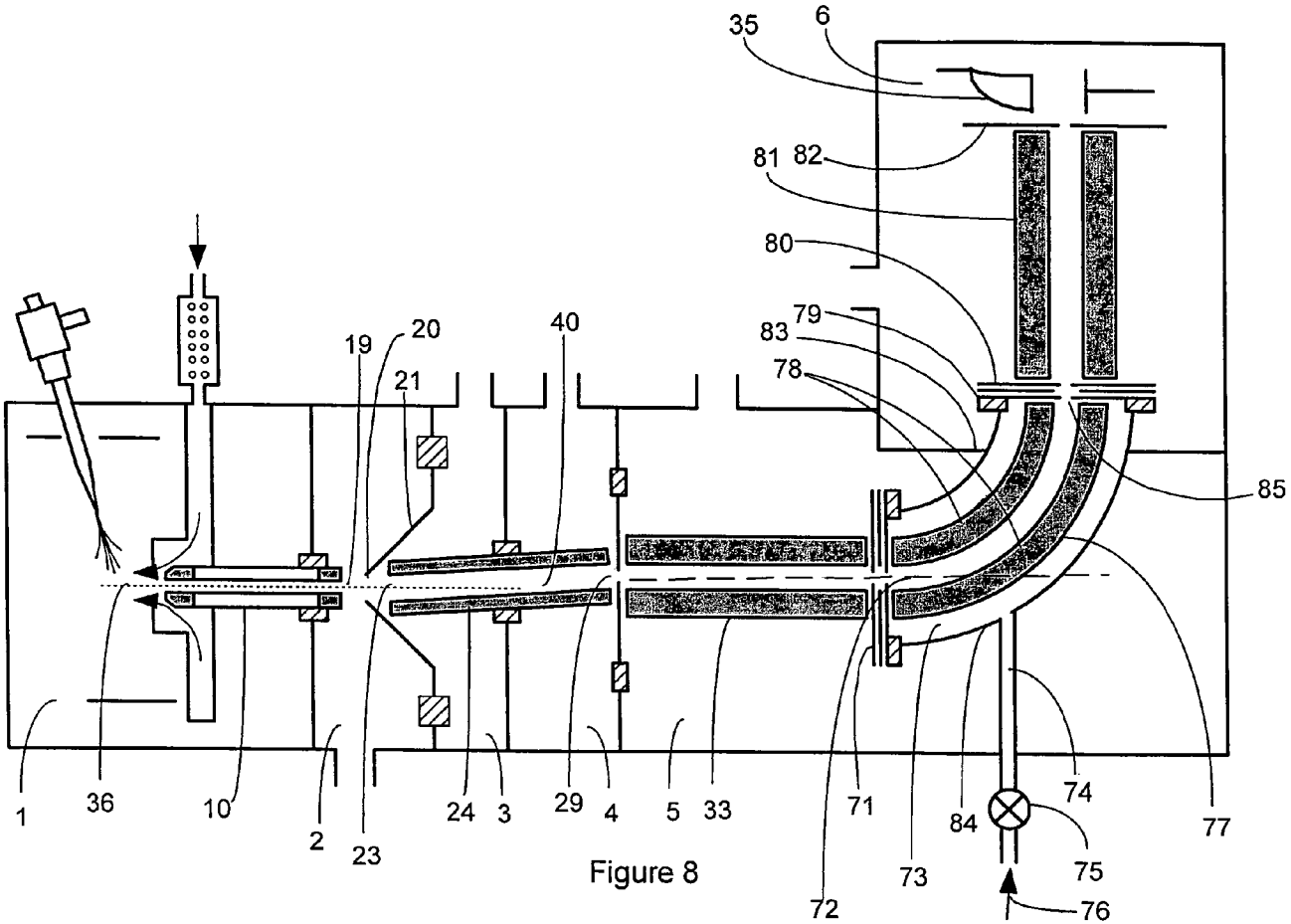
FIG. 8 schematically illustrates an embodiment of the invention in a 'triple-quadrupole' configuration, in which ions from an ESI ion source are carried into vacuum via a dielectric capillary, pass through a skimmer, and are then transported to a first quadrupole mass analyzer by a multipole ion guide that extends through a vacuum partition to provide optimum ion transport, and which is tilted at an angle with respect to the entrance axis of the mass filter in order to prevent background particles from proceeding into a collision cell downstream of the first mass analyzer. The collision cell is configured with an ion guide with a continuous curve along its length, such that entrance portion of the ion guide is coaxial with the first quadrupole mass filter, and the exit portion is coaxial with the entrance axis of a second quadrupole mass filter, and at an angle of ninety degrees with respect to the axis of the first mass quadrupole mass filter, thereby preventing background particles from the collision cell, or upstream of the collision cell, from reaching the detector located downstream of the second quadrupole mass filter.

Another alternative embodiment of the invention is illustrated in FIG. 8. FIG. 8 depicts an embodiment of the present invention in a so-called 'triple quad' configuration, in which ions from an ion source 1 are transported via a tilted ion guide 24 to a quadrupole mass filter 33 in vacuum pumping stage 5. 'Parent' ions to be subsequently fragmented to produce 'daughter' ions are selected in quadrupole mass filter 33, and are focused and accelerated through lens 71, which is shown in FIG. 8 as a three-element lens, along the quadrupole mass filter axis 72 into collision cell 73. The accelerated parent ions collide with collision gas molecules in collision cell 73 with enough kinetic energy that the parent ions fragment into daughter ion fragments and neutral fragments. Collision cell 73 comprises curved quadrupole ion guide 77 within enclosure 84, and is provided within the enclosure 84 with collision gas 76 via regulator valve 75 and gas delivery tube 74. Curved ion guide 77 could alternatively be configured with six, or eight, or more than eight rods. Fragment ions and any remaining parent ions are guided to the collision cell exit aperture 85 by curved ion guide 77, where the ions are focused through three-element focus lens 80 into quadrupole mass filter 81 in vacuum pumping stage 6, and then the mass analyzed ions are detected with detector 35.

The configuration of the embodiment depicted in FIG. 8 is shown to be essentially the same as the configuration of FIG. 1 from the ion source through quadrupole mass filter 33. Therefore, background particles produced upstream of location 40 in ion guide 24 are prevented from line-of-sight past the aperture of lens 71 at the exit end of quadrupole mass filter 33, due to the tilt angle 39, as well as tilt angle 38 in this case, as discussed above in relation to the embodiment of FIG. 1. Consequently, such background particles are prevented from entering collision cell 73. Energetic background particles, which would not have been filtered very well with quadrupole mass filter 33 due to their high energy and/or lack of charge, if allowed to enter collision cell 73, would have collided with collision gas molecules to produce background fragment ions from the background particles. Such background fragment ions would appear in the fragment ion mass spectra produced by quadrupole mass filter 81, and would complicate the analysis.

Moreover, the curved collision cell, according to this embodiment of the invention, prevents a line-of-sight from anyplace along axis 72 within collision cell 73, to mass analyzer detector 35 or surfaces in the vicinity of detector 35 downstream of exit lens 88. Hence, any energetic fragment ions or neutral fragments that are created as a result of collisions between ions and collision gas molecules in the collision cell 73, will not have line-of-sight to the detector 35, and therefore will be prevented from created background particle noise, according to this embodiment of the invention. Additionally, the transmission for ions between vacuum stage 5 and vacuum stage 6 is enhanced by configuring the collision cell 73 to extend continuously between vacuum stages 5 and 8.

Figure 9:
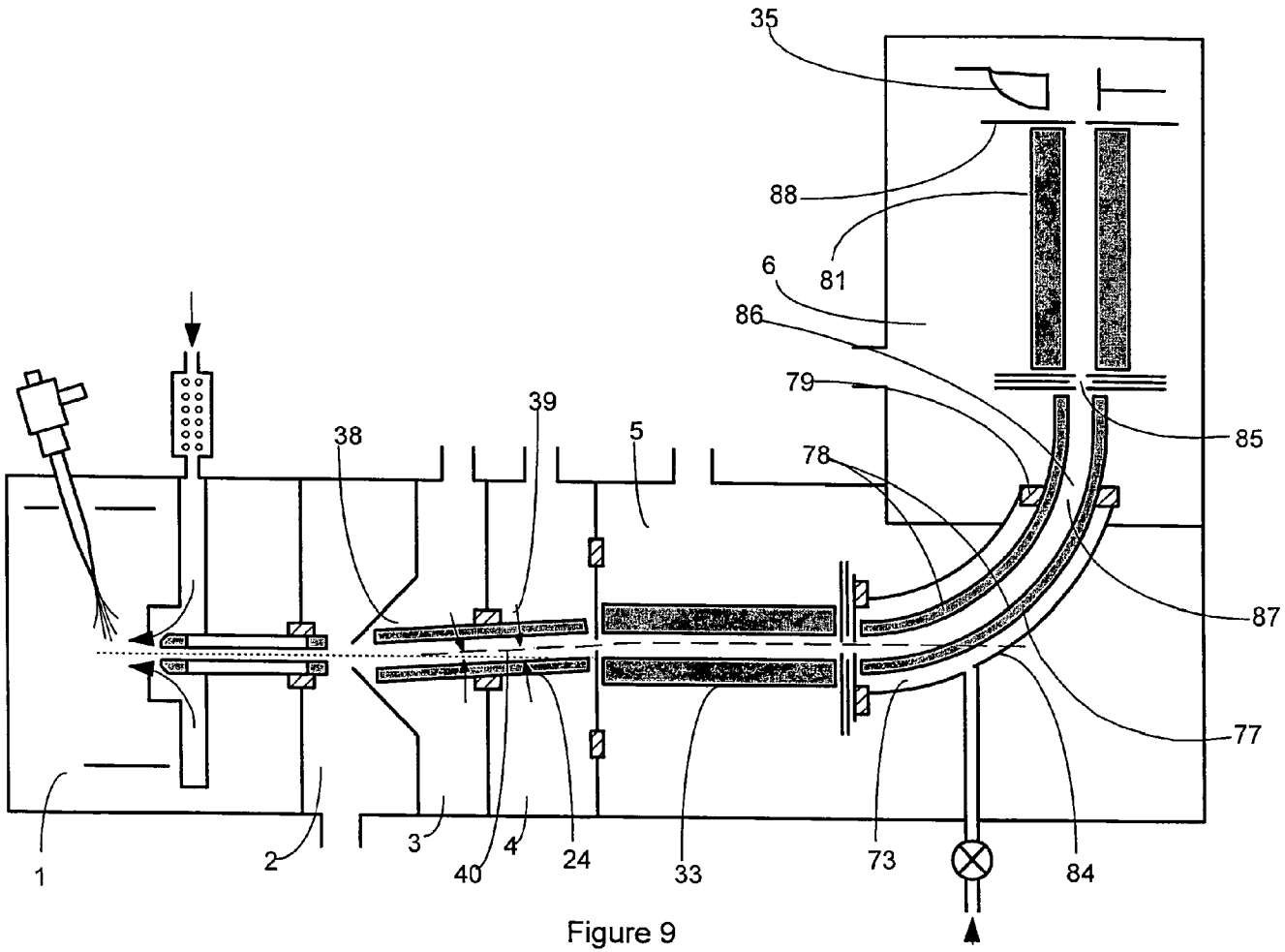
FIG. 9 schematically illustrates an embodiment of the invention in a 'triple-quadrupole' configuration, in which ions from an ESI ion source are carried into vacuum via a dielectric capillary, pass through a skimmer, and are then transported to a first quadrupole mass analyzer by a multipole ion guide that extends through a vacuum partition to provide optimum ion transport, and which is tilted at an angle with respect to the entrance axis of the mass filter in order to prevent background particles from proceeding into a collision cell downstream of the first mass analyzer. The collision cell is configured with an ion guide with a continuous curve along its length, such that entrance portion of the ion guide is coaxial with the first quadrupole mass filter, and the exit portion is coaxial with the entrance axis of a second quadrupole mass filter, and at an angle of ninety degrees with respect to the axis of the first mass quadrupole mass filter, thereby preventing background particles from the collision cell, or upstream of the collision cell, from reaching the detector located downstream of the second quadrupole mass filter. The exit portion of the collision cell ion guide extends continuously through the collision cell exit partition to provide optimum ion transport through the collision cell exit partition.

The embodiment of the invention illustrated in FIG. 9 is essentially identical to the embodiment of FIG. 8, except that the curved rods 78 of curved ion guide 77 are mounted via insulator 79 which forms an extension of the collision cell 73 enclosure 84. This configuration allows curved collision cell ion guide 77 to extend continuously from inside the collision cell to outside the collision cell, as illustrated in FIG. 9. Such a configuration, according to the present invention, provides better ion transport efficiency for ions exiting the collision cell, as well as lower background particle noise, in comparison with the conventional arrangement of an exit aperture 85 which forms an extension to collision cell enclosure 84 as shown in FIG. 8. The reason for the better ion transport efficiency of FIG. 9 is that, in the embodiment of FIG. 8, ions may be scattered by the RF fringe fields at the exit aperture 85 due to the RF voltages applied to the curved rods 78 of curved ion guide 77. Ions are also scattered, in the embodiment of FIG. 8, by collisions with collision gas molecules in the regions proximal to exit aperture 85 as they pass out of the guiding RF fields within curved ion guide 77 and through the exit aperture 85 in the embodiment of FIG. 8, resulting in ion loss, as well as the creation of background particles that are created from such collisions. In contrast, in the embodiment of FIG. 9, ions are guided by the RF fields within curved ion guide 77 through the exit 87 of curved collision cell 84 of FIG. 9, and only pass out of these guiding RF fields and through exit aperture 85 within vacuum stage 6, that is, within a background gas pressure that is low enough that collisions between ions and background gas molecules essentially do not occur, resulting in better ion transport efficiency, as well as the avoidance of the creation of background particles as ions pass through the RF fringe fields proximal to aperture 85.

Furthermore, lower background particle noise is provided by the configuration of FIG. 9, compared to that of FIG. 8, also because the last location at which ions may collide with collision gas molecules is location 88 in FIG. 9, just downstream of collision cell exit 87. Location 86 occurs in ion guide 77 some distance upstream of exit aperture 85, that is, where curved ion guide 77 is still curving. Because of this arrangement, background particles created in collisions between ions and collision gas molecules at location 86 do not have line-of-sight to detector 35, or surfaces in the region of detector 35 downstream of quadrupole exit lens 88. Hence, the extension of ion guide 77 continuously through collision cell partition 84 via mounting insulator 79 provides both improved ion transport from collision cell 73 into subsequent quadrupole mass filter 81, while preventing background particles resulting from collisions between ions and collision gas molecules from creating background particle noise at the detector 35, according to the embodiment of the invention of FIG. 9.

Figure 10:
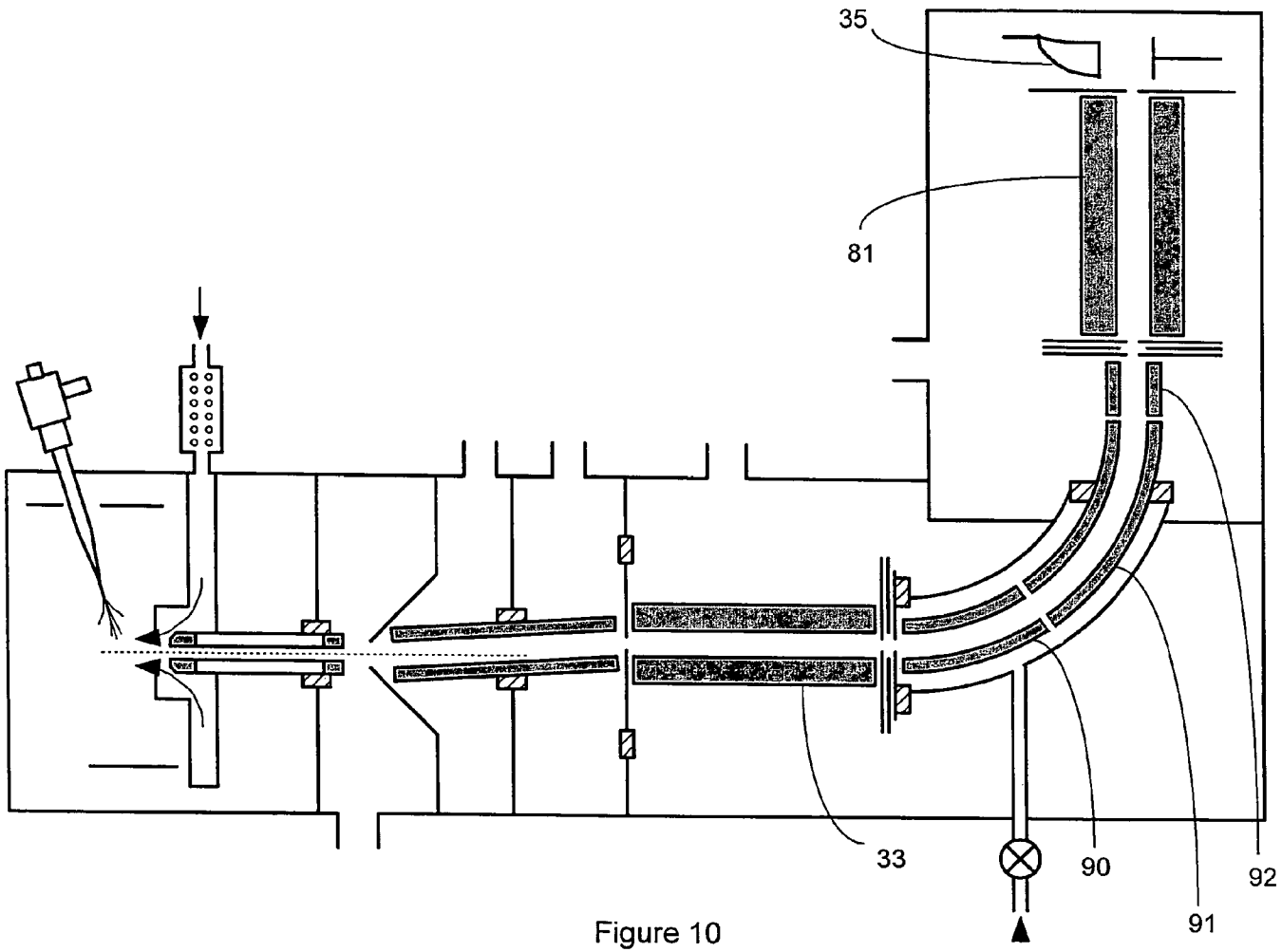
FIG. 10 schematically illustrates an embodiment of the invention in a 'triple-quadrupole' configuration, in which ions from an ESI ion source are carried into vacuum via a dielectric capillary, pass through a skimmer, and are then transported to a first quadrupole mass analyzer by a multipole ion guide that extends through a vacuum partition too provide optimum ion transport, and which is tilted at an angle with respect to the entrance axis of the mass filter in order to prevent background particles from proceeding into a collision cell downstream of the first mass analyzer. The collision cell is configured with two ion guide segments along a continuous curve, such that entrance portion of the first ion guide segment is coaxial with the first quadrupole mass filter, and the exit portion of the second segment is coaxial with the entrance axis of a second quadrupole mass filter, and at an angle of ninety degrees with respect to the axis of the first mass quadrupole mass filter, thereby preventing background particles from the collision cell, or upstream of the collision cell, from reaching the detector located downstream of the second quadrupole mass filter. The exit portion of the second collision cell ion guide segment extends continuously through the collision cell exit partition to provide optimum ion transport through the collision cell exit partition. The segmented collision cell ion guide provides additional analytical functionality, such as the capability of $MS/MS^n$.

FIG. 10 illustrates an embodiment of the invention which is essentially the same as the embodiment of FIG. 9, except that the collision cell 73 ion guide 77 of FIG. 9 is segmented into three separate and independent ion guide segments 90, 91, and 92 in the embodiment of FIG. 10, where any or all ion guide segment 90, 91, and 92 may have the possibility of separate DC and RF voltages applied. Configuring the ion guide in collision cell 73 into segments 90, 91, and 92 affords additional capabilities relative to the embodiment of FIG. 9. For example, fragment ions may be produced via CID by accelerating parent ions into ion guide segment 90 from quadrupole mass filter 33. Simultaneously, RF voltages may be applied to the rods of ion guide segment 90 which cause resonant-frequency excitation radial ejection of all ions except fragment ions with a selected m/z value. These m/z selected fragment ions may then be axially-accelerated by a DC offset voltage difference between ion guide segments 90 and 91, resulting in CID of the selected fragment ions. The resulting second generation fragment ions may then be m/z analyzed by directing them through ion guide segment 92 and into mass analyzer 81 and detector 35.

Figure 11A:
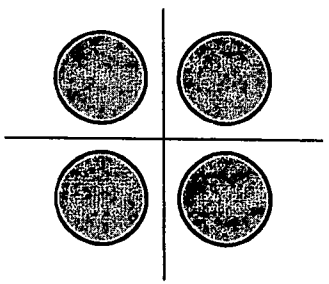
FIG. 11A-D schematically illustrate cross-sectional views for a variety of possible ion guide configurations according to the invention.
Figure 11B:
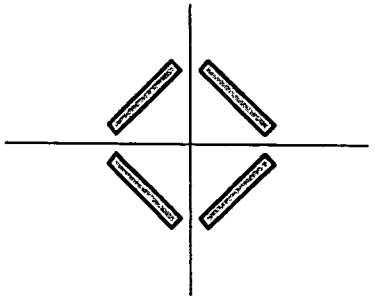
Figure 11C:
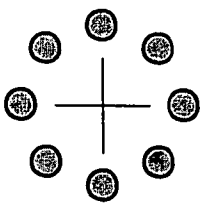
Figure 11D:
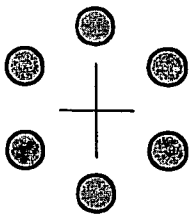

In any of the embodiments of the invention described above, it is to be understood that any of the ion guides or ion guide segments may be configured as a quadrupole ion guide, having four poles, or rods, arranged symmetrically about a central axis, as shown in cross-section in FIG. 11A. Alternatively, a greater number of rods, or poles, may be utilized in any of the RF ion guides or ion guide segments described previously. For example six rods or poles may be incorporated, as illustrated in FIG. 11D, or eight poles or rods as depicted in FIG. 11C, or more than eight rods or poles may be used in any of the ion guides or ion guide segments described herein. Also, it is to be understood that any of the ion guides or ion guide segments described herein may be configured with poles that are not circular in cross-section. For example, flat plates are also within the scope of the present invention, as illustrated in the quadrupole arrangement of FIG. 118. Further, it is also within the scope of the invention that so-called 'stacked-ring' RF ion guides may be incorporated as an ion guide for the transport of ions in any of the embodiments of the invention.

It should also be understood that, while the embodiments described herein have incorporated an ESI ion source as the source of ions, any ion source may be used in any of the embodiments instead, within the scope of the invention. In particular, other ion sources that operate at or near atmospheric pressure, such as atmospheric pressure chemical ionization (APCI), inductively coupled plasma (ICP), and atmospheric pressure (AP-) MALDI and laser ablation ion sources, may be incorporated within the scope of the invention. Other types of ion sources which operate at intermediate vacuum pressures, such as glow discharge or intermediate pressure (IP-) MALDI and laser ablation ion sources, or other types of ion sources that are configured in a vacuum region in which the vacuum pressure rises significantly during operation of the ion source, such as electron ionization and chemical ionization ion sources, may also be used within the scope of the invention.

In addition, it is to be further understood that the method and/or apparatus that is employed to transport ions from the ion source to the entrance of the first ion guide is not limited to a dielectric capillary interface as described in the aforementioned embodiments, but may also include, within the scope of the invention, a metal capillary, a nozzle or orifice, an array of orifices, or any other conduit that may be used for this purpose, as appropriate for the ion source and vacuum conditions at hand.

Furthermore, it is to be understood that, while a quadrupole mass filter has been configured in the embodiments described herein, the scope of the invention also encompasses other types of mass analyzers, including three-dimensional ion traps, magnetic sector mass analyzers, time-of-flight mass analyzers with either axial pulsing or orthogonal pulsing, two-dimensional ion traps with axial resonant ejection.

Although the present invention has been described in accordance with the embodiments shown, one of ordinary skill in the art will recognize that there could be variations to the embodiments, and those variations would be within the spirit and scope of the present invention.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

The invention claimed is:

1. An apparatus for the analysis of a sample substance, comprising:

a. an ion source for producing ions from said sample substance;

b. at least two vacuum regions, wherein said vacuum regions are separated from each other by partitions, and wherein said vacuum regions are in communication with each other such that said ions can move through said partitions, wherein the apparatus is operated so that the at least two vacuum regions have different background gas pressures;

c. a mass analyzer located in at least one of said vacuum regions, said mass analyzer having a linear entrance axis along which said ions enter said mass analyzer;

d. a mass analyzer detector located in a detector region;

e. at least one RF multipole ion guide comprising an entrance end and an exit end, wherein ions move through said ion guide from said entrance end to said exit end, wherein said ion guide further comprises a first portion that is a curved, non-segmented portion, wherein said first portion further comprises a first curved ion guide axis extending longitudinally along and radially concentric with the entire length of said first portion, wherein said first portion extends continuously from a first of said vacuum regions, through a first of said vacuum partitions, and into at least a second of said vacuum regions, such that a first part of said first portion is located within said first vacuum region, and a second part of said first portion is located within said second vacuum region, and wherein the background gas pressure in said first vacuum region is sufficiently high that collisions between said ions and background gas molecules occur in said first part, and wherein the background gas pressure in said second vacuum region is sufficiently low that collisions between said ions and background gas molecules essentially do not occur in said second part or in any subsequent part of said ion guide through to said ion guide exit end;

f. means for transferring said ions from said ion source into said entrance end of said RF multipole ion guide;

g. a first linear axis extending from and tangential to said first curved ion guide axis at said entrance end of said ion guide, wherein said ions enter said ion guide along said first linear axis; and, h. a second linear axis extending from and tangential to said first curved ion guide axis at said exit end of said ion guide, wherein said second linear axis is coincident with said linear mass analyzer entrance axis, whereby the curvature of said second part of said first portion is sufficient such that background particles created in said ion source or in said first vacuum region have essentially no line-of-sight with said detector or detector region.

2. The apparatus of claim 1 wherein said multipole ion guide comprises at least two multipole ion guide segments.

3. The apparatus of claim 1 wherein said at least two vacuum regions comprises three or more vacuum regions.

4. The apparatus of claim 1, wherein said ion source operates essentially at atmospheric pressure.

5. The apparatus of claim 4, wherein said ion source is an electrospray ion source, an atmospheric pressure matrix-assisted laser desorption ion source, or a laser ablation ion source.

6. The apparatus of claim 1, wherein said ion source operates below atmospheric pressure.

7. The apparatus of claim 6, wherein said ion source is a glow discharge ion source, an intermediate pressure matrix-assisted laser desorption ion source, a laser ablation ion source or an electron ionization ion source, or a chemical ionization ion source.

8. The apparatus of claim 1, wherein said mass analyzer is a quadrupole mass filter, a three-dimensional ion trap or a magnetic sector mass analyzer, a time-of-flight mass analyzer with axial pulsing, a time-of-flight mass analyzer with orthogonal pulsing, or a two-dimensional ion trap with axial resonant ejection.

9. The apparatus of claim 1, wherein said multipole ion guide comprises four poles or six poles or eight poles or more than eight poles.

10. The apparatus of claim 9, wherein said poles comprise round rods or flat plates.

11. The apparatus of claim 1, wherein said multipole ion guide comprises a plurality of rings comprising a stacked ring ion guide.

12. The apparatus of claim 1, wherein the at least two vacuum regions are different vacuum pumping stages.

13. The apparatus of claim 1, wherein said ion guide is exposed to an atmosphere of each vacuum region it extends through.

* * * * *